US007098934B2

(12) United States Patent
Arimoto et al.

(10) Patent No.: US 7,098,934 B2
(45) Date of Patent: Aug. 29, 2006

(54) LIQUID CRYSTAL DISPLAY AND ITS DRIVING METHOD

(75) Inventors: Katsuyuki Arimoto, Okayama (JP); Yoshihito Ohta, Okayama (JP); Takahiro Kobayashi, Okayama (JP); Tsugio Murao, Habikino (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 448 days.

(21) Appl. No.: 10/473,793

(22) PCT Filed: Oct. 17, 2002

(86) PCT No.: PCT/JP02/10776

§ 371 (c)(1),
(2), (4) Date: Oct. 2, 2003

(87) PCT Pub. No.: WO03/036605

PCT Pub. Date: May 1, 2003

(65) Prior Publication Data

US 2004/0150605 A1 Aug. 5, 2004

(30) Foreign Application Priority Data

Oct. 23, 2001 (JP) ..... 2001-324717

(51) Int. Cl.
*G09G 5/10* (2006.01)

(52) U.S. Cl. ..... 345/690; 345/87

(58) Field of Classification Search ..... 345/87–89, 345/94, 90, 98–100, 204, 208, 690, FOR. 135
See application file for complete search history.

(56) References Cited

U.S. PATENT DOCUMENTS 5,040,874 A * 8/1991 Fukuda ..... 345/87
5,943,034 A * 8/1999 Adachi ..... 345/94
6,236,388 B1 * 5/2001 Iida et al. ..... 345/698
6,396,469 B1 * 5/2002 Miwa et al. ..... 345/87

(Continued)

FOREIGN PATENT DOCUMENTS

JP 1-295228 11/1989

(Continued)

OTHER PUBLICATIONS

Japanese Liquid Crystal Society Journal vol. 3, No. 2, p. 99 (17)-p. 106 (24), Apr. 25, 1999.

*Primary Examiner*—Bipin Shalwala
*Assistant Examiner*—Tom Sheng
(74) *Attorney, Agent, or Firm*—Wenderoth, Lind & Ponack, L.L.P.

(57) ABSTRACT

A frequency converting section (101), which is included in a liquid crystal display apparatus, generates an output video signal by inserting one non-image signal, which is to be concurrently written into pixels on L (L is an integer equal to or greater than two) gate lines of the liquid crystal panel, for one line, between image signals composing an input video signal, for corresponding L lines, and adjusting a number of horizontal scanning periods of the output video signal in a vertical blanking period so that a number of horizontal scanning periods composing one frame period is (L+1)×(2N+1) (N is an integer). Thus, when anti-back-transition driving is performed using a liquid crystal panel in OCB mode, it is possible to minimize increase in a driving frequency, prevent irregularity of brightness caused by AC driving of the liquid crystal panel, and reduce a cost.

18 Claims, 32 Drawing Sheets

U.S. PATENT DOCUMENTS

| | | | | |
|---|---|---|---|---|
| 6,545,656 | B1 * | 4/2003 | Yamazaki | 345/94 |
| 6,836,293 | B1 * | 12/2004 | Itoh et al. | 348/452 |
| 6,989,812 | B1 * | 1/2006 | Arimoto et al. | 345/98 |
| 2002/0044117 | A1 * | 4/2002 | Matsumura et al. | 345/87 |

FOREIGN PATENT DOCUMENTS

| | | |
|---|---|---|
| JP | 4-309995 | 11/1992 |
| JP | 8-331486 | 12/1996 |
| JP | 11-109921 | 4/1999 |
| JP | 2000-122596 | 4/2000 |
| JP | 2001-166280 | 6/2001 |
| JP | 2002-229004 | 8/2002 |
| JP | 2002-328654 | 11/2002 |

* cited by examiner

LIQUID CRYSTAL DISPLAY AND ITS DRIVING METHOD

TECHNICAL FIELD

The present invention relates to a liquid crystal display apparatus and, particularly, relates to a liquid crystal display apparatus suitable for display of moving images using a liquid crystal panel, and suitable for a case where a liquid crystal panel in Optically self-Compensated Birefringence (OCB) mode is used.

BACKGROUND ART

Many liquid crystal display apparatuses are used as display devices for computers, etc., and are expected to be widely used for TV in future years. However, a liquid crystal display panel in Twisted Nematic (TN) mode, which is now widely used, has some shortcomings, namely, narrow viewing angles and inadequate response speeds. Consequently, there are some major problems to be solved, for example, reduction in a contrast due to parallax or blurred outlines at the time of displaying moving images, in order to use the liquid crystal panel in TN mode for TV.

In recent years, research on OCB mode, which is replacing the above-described TN mode, has been conducted. The OCB mode of operation allows for wide viewing angles and enhanced response speeds, thereby being more suitable for displaying moving images than the TN mode.

FIG. 26 shows the structure of a commonly-used liquid crystal panel, which is common to the TN mode and the OCB mode. In FIG. 26, X1 to Xn indicate gate lines, and Y1 to Yn indicate source lines. Thin film transistors 2604 (hereinafter, referred to as a TFT) are provided as a switching element at intersection of the gate lines X1 to Xn with the source lines Y1 to Yn. The drain electrode of each TFT 2604 is connected to a pixel electrode of each pixel 2605 of the liquid crystal panel. In each pixel 2605, a liquid crystal is sandwiched between the pixel electrode and a counter electrode. A polarity of the counter electrode is controlled by a counter driving section 2603.

2602 indicates a gate driver for supplying a gate pulse, which controls the ON/OFF states of the TFTs 2604, to the gate lines X1 to Xn. The gate driver 2602 synchronizes with data supply to the source lines Y1 to Yn, and sequentially applies a potential to the gate lines X1 to Xn, which turns the states of the TFT 2604 ON. 2601 indicates a source driver for controlling a potential of the pixel electrode. A difference between a potential of the pixel electrode controlled by the source driver 2601 and a potential of the counter electrode controlled by the counter driving section 2603 is a voltage to be applied to the liquid crystal, and transmittance of each pixel 2605 is determined based on the above-described voltage.

Now, in a case where the liquid crystal panel in OCB mode is used, special processing, which is not performed for the TN mode, is required at the first stage of commencing image display. A state of OCB cells can be either a bend configuration or a splay configuration. In order to display an image on the liquid crystal panel in OCB mode, the OCB cells have to be in a bend configuration state. However, in general, the OCB cells are in a state of a splay configuration. Therefore, a state of the OCB cells has to be changed from a splay configuration to a bend configuration for displaying an image. Hereinafter, the above-described state change from a splay configuration to a bend configuration is referred to as a "transition". In order to cause a transition of the OCB cells, special processing, for example, applying a high voltage for a predetermined period of time, is required. However, this processing is not directly related to the present invention, and therefore not further described herein.

After the above-described special processing causes the state of OCB cells to make a transition to a bend configuration, image display becomes possible. However, if a voltage equal to or greater than a predetermined level is not applied to the OCB cells for a period equal to or greater than a predetermined period of time, the state of the OCB cells returns back from a bend configuration to a splay configuration. Hereinafter, the above-described state change from a bend configuration to a splay configuration is referred to as a "back transition". Thus, in order to continue image display using the liquid crystal panel in OCB mode, it is necessary to prevent a back transition. A back transition can be prevented by applying a high voltage to the OCB cells on a regular basis, as disclosed in Japanese Patent Laid-Open Publication No. H11-109921 and Japanese Liquid Crystal Society Journal, Apr. 25, 1999 (Vol. 3, No. 2) P.99 (17) through P.106 (24). Hereinafter, such a driving scheme of a liquid crystal panel, in which a high voltage is applied to the OCB cells on a regular basis, is referred to as "anti-back-transition driving".

Now, as is well known, in a commonly-used liquid crystal panel typified by the OCB mode and the TN mode, a direct voltage applied to liquid crystal cells causes a problem such as burn-in. Therefore, when the liquid crystal panel is driven, it is necessary to perform so-called AC driving, in which polarity of the voltage applied to the liquid crystal cells is alternately inverted. This is also applied to a case where the liquid crystal panel is driven by the above-described anti-back-transition driving. However, in the above-described Japanese Patent Laid-Open Publication No. H11-109921 and Japanese Liquid Crystal Society Journal, a structure or an operation of a liquid crystal display apparatus in a case where an AC driving scheme is used for the anti-back-transition driving is not specifically described, and the above-described documents do not reveal a concrete method to apply an AC driving scheme to the anti-back-transition driving.

Now, the above-described documents disclose a scheme in which source drivers are placed on upper and under sides or a scheme in which driving frequency is doubled, in order to alternately write an image signal and a high voltage signal (a signal for periodically applying a high voltage to OCB cells). However, those schemes have a problem such as increase in cost because there is a need to use two source drivers, or inadequate writing of signal into OCB cells due to reduced signal writing time caused by the doubled driving frequency. Therefore, inventers of the present invention realize anti-back-transition driving by which increase in driving frequency is minimized. Hereinafter, as a related art of the present invention, a liquid crystal display apparatus to which anti-back-transition driving is applied will be described.

In FIG. 27, the structure of the above-described liquid crystal display apparatus according to the related art is shown. In FIG. 27, 2701 indicates a frequency converting section performing frequency conversion for an input video signal, 2702 indicates a driving pulse generating section generating pulses for controlling a source driver and a gate driver, respectively, 2601 indicates the source driver, 2602 indicates the gate driver, and 2703 indicates a liquid crystal panel in OCB mode. Note that, for the sake of convenience, the number of gate lines of the liquid crystal panel 2703 is assumed to be 12 lines, and one frame period is assumed to be composed of 12 horizontal scanning periods.

In this liquid crystal display apparatus, one image signal included in an input video signal and one non-image signal which is irrelevant to the input video signal are written into each pixel on the liquid crystal panel 2703 during one frame period. Here, the non-image signal is a signal for applying a high voltage to OCB cells in order to prevent a back transition. In order to realize the above-described writing, it is necessary to insert the non-image signal between the image signals composing the input video signal. Therefore, the frequency converting section 2701 of this liquid crystal display apparatus generates an output video signal by inserting one non-image signal for every four image signals (image signals corresponding to four lines) of an input video signal, and transfers it to the source driver 2601. At the same time, the frequency converting section 2701 also performs frequency conversion because mere insertion of the non-image signal could change a length of one frame period. That is, in order to transfer five signals including four image signals and one non-image signal to the source driver within a time period in which four image signals are input as an input video signal (that is, within four horizontal scanning periods), 1.25 times frequency conversion is performed.

In FIG. 28, a concrete structure of the frequency converting section 2701 is shown. A control signal generating section 2801 generates a writing clock, a reading clock, a read enable signal, an output switching control signal, and an output synchronizing signal, respectively, based on an input synchronizing signal. An input video signal is synchronized with the writing clock, and written into a line memory 2802. Then, the input video signal written into the line memory 2802 is synchronized with the reading clock whose frequency is 1.25 times higher than that of the writing clock, and read from the line memory 2802. Based on the output switching control signal, an output signal selecting section 2804 selects either an output of the line memory 2802 or an output of a non-image signal generating section 2803, and outputs it as an output video signal. A signal waveform related to the above-described processing is shown in FIG. 29.

An input/output characteristic of the source driver 2601 is shown in FIG. 30. The source driver 2601, in which the output video signal output from the frequency converting section 2701 is input, alternately converts a signal level of the output video signal so as to be a level greater or smaller than a reference potential, in accordance with a polarity control signal output from the driving pulse generating section 2702, and outputs it. When a level of an output signal of the source driver 2601 is greater than the reference potential, a positive voltage is applied to liquid crystal cells. On the other hand, when a level of an output signal of the source driver 2601 is smaller than the reference potential, a negative voltage is applied to the liquid crystal cells. Also, the greater a signal level of the output video signal becomes, the closer a level of the output signal of the source driver 2601 approaches the reference potential (that is, a voltage applied to the liquid crystal cells becomes smaller).

In FIG. 31, gate pulses P1 to P12 respectively select gate lines GL 1 to GL 12 on the liquid crystal panel 2703 during their respective HI periods. Note that "+", "−" marked in the HI period of the respective gate pulses P1 to P12 indicate a polarity of a signal (that is, a polarity of an applied voltage) written into a pixel on the gate line selected by the gate pulse. During a period T0_0, the gate pulses P5 to P8 becomes HI at the same time, and a non-image signal in positive polarity is concurrently written into pixels on the gate lines GL5 to GL8. During a following period T0_1 through T0_4, the gate pulses P1 to P4 sequentially become HI, and image signals S1 to S4 in positive polarity are sequentially written into pixels on the gate lines GL1 to GL4. During a period T0_5, the gate pulses P9 to P12 become HI at the same time, and a non-image signal in negative polarity is concurrently written into the gate lines GL9 to GL12. During a following period T0_6 through T0_9, the gate pulses P5 to P8 sequentially become HI, and image signals S5 to S8 in negative polarity are sequentially written into pixels on the gate lines GL5 to GL8, respectively. Here, the respective pixels on the gate lines GL5 to GL8 hold the non-image signal after the non-image signal is written thereinto until an image signal is written thereinto, that is, during the time periods T0_1 through T0_5, T0_1 through T0_6, T0_1 through T0_7, T0_1 through T0_8, respectively. As such, all the gate lines on the liquid crystal panel 107 are respectively selected twice during one frame period, and one image signal and one non-image signal are written into each pixel on the respective gate lines during one frame period.

During a period T1_0 in a following frame period, the gate pulses P5 to P8 become HI at the same time, and the non-image signal in negative polarity (polarity opposite to that in the previous frame) is written into pixels on the gate lines GL5 to GL8. During a following period T1_1 trough T1_4, the gate pulses P1 to P4 sequentially become HI, and image signals S'1 to S'4 in negative polarity (polarity opposite to that in the previous frame) are sequentially written into the pixels on the gate lines GL1 to GL4.

As described above, according to the liquid crystal display apparatus shown in FIG. 27, it is possible to alternately write an image signal and a non-image signal into each pixel on the liquid crystal panel 2703 while minimizing increase in a driving frequency (Japanese Patent Application No. 2001-131414).

Now, the anti-back-transition driving performed by the above liquid crystal display apparatus (that is, anti-back-transition driving by which increase in a driving frequency is minimized by concurrently writing a non-image signal into a plurality of gate lines) restricts the number of horizontal scanning periods composing one frame period.

For example, in a scheme typified by the above-described liquid crystal display apparatus, in which a non-image signal is concurrently written into four gate lines, the number of horizontal scanning periods composing one frame period has to be an odd multiple of five at the time of completion of frequency conversion (that is, in an output video signal). In the example of FIG. 31, the number of horizontal scanning periods composing one frame period (period T0_0 through T0_14) in the output video signal is 15 (an odd multiple of five), thereby satisfying the condition. In general terms, this condition is expressed such that, in a scheme in which a non-image signal is concurrently written into L gate lines, the number of horizontal scanning periods composing one frame period has to be $(L+1)\times(2N+1)$ at the time of completion of frequency conversion. If this condition is not satisfied, there will appear irregularity of brightness, that is, some lines are relatively bright and some lines are relatively dark, on a display screen of the liquid crystal panel 2703. Hereinafter, a cause thereof will be briefly described.

FIG. 32 shows various signal waveforms in a scheme in which a non-image signal is concurrently written into three gate lines. In this example, the number of horizontal scanning periods composing one frame period in the output video signal is 16, which is not an odd multiple of four (=3+1), whereby the above-described condition is not satisfied. In FIG. 32, a polarity change of a signal written into pixels on each gate line shows that an image signal whose polarity is opposite to a non-image signal is sure to be written into the gate lines GL1 to GL3 immediately before the non-image signal is written thereinto. On the other hand, with respect to the gate lines GL4 to GL12, an image signal having the same polarity of a non-image signal is sure to be written thereinto immediately before the non-image signal is written thereinto. Now, into a liquid crystal cell into which a signal having a given polarity has already been written, if a signal whose polarity is opposite to that of the above-described signal is written thereinto, there arises a problem of inadequate signal writing compared to a case where a signal having the same polarity of the above-described signal is written thereinto. For this reason, in the example of FIG. 32, writing of a non-image signal into pixels on the gate lines GL1 to GL3 is inadequate compared to writing of a non-image signal into pixels on the other gate lines GL4 to GL12, which results in a difference in brightness between a portion corresponding to the gate lines GL1 to GL3 on the liquid crystal panel 107 and a portion corresponding to the gate lines GL4 to GL12. As such, irregularity of brightness is caused if the aforementioned condition is not satisfied.

In order to prevent the above-described irregularity of brightness, the number of horizontal scanning periods has to be adjusted. However, mere increase or decrease of the number of horizontal scanning periods causes a time lag between writing and reading of an image signal into/from the line memory 2802 as shown in FIG. 29, whereby the line memory 2802 for one line may be insufficient for proper transfer of an image signal (that is, the image signal may be lost). In order to reliably avoid the above-described problem, it is necessary to provide a memory such as a frame memory, for example, capable of concurrently storing image signals for two or more lines, which results in increase in cost of the liquid crystal display apparatus.

Therefore, an object of the present invention is to provide a low-cost liquid crystal display device capable of performing anti-back-transition driving by which increase in a driving frequency is minimized and display of a good-quality video by reducing the occurrence of irregularity of brightness is possible.

DISCLOSURE OF THE INVENTION

To achieve the above objects, the present invention has the following aspects. Note that notes in parentheses indicate exemplary elements which can be found in the embodiments to follow, though such notes are not intended to limit the scope of the invention.

A liquid crystal display apparatus of the present invention displays video by driving a liquid crystal panel based on an input video signal, comprising: a liquid crystal panel (107) having a plurality of source lines and a plurality of gate lines; a frequency converting section (101) for generating an output video signal by inserting one non-image signal, which is to be concurrently written into pixels on L (L is an integer equal to or greater than two) gate lines of the liquid crystal panel, for one line, between image signals composing the input video signal, for corresponding L lines, and adjusting the number of horizontal scanning periods of the output video signal so that a number of horizontal scanning periods composing one frame period is $(L+1)\times(2N+1)$ (N is an integer); and a driver (105) for driving the liquid crystal panel based on the output video signal generated by the frequency converting section, and the frequency converting section increases/decreases a number of horizontal scanning periods included in a vertical blanking period, thereby adjusting the number of horizontal scanning periods composing one frame period. Thus, the non-image signal is regularly inserted, and irregularity of brightness does not occur even if AC driving is performed for the liquid crystal panel. Furthermore, the number of horizontal scanning periods is adjusted during the vertical blanking period, whereby it is not necessary to use a memory concurrently storing image signals corresponding to two or more lines. Also, it is possible to adjust the number of horizontal scanning periods without affecting video displayed on the liquid crystal panel. Note that "one frame period" is a period including not only an active video period but also a following vertical blanking period. Also, "the number of horizontal scanning periods composing one frame period" translates to the number of periods chopped by horizontal synchronizing signals in one frame period. Specifically, in FIG. 6, it is 50 with respect to the input video signal, and also it is 65 with respect to the output video signal.

Note that "a back-transition" in claims is a phenomenon in which a state of OCB cells is changed from a bend configuration to a splay configuration. Also, "an adjusting period included in the vertical blanking period" does not rule out a case where the vertical blanking period coincides with the adjusting period.

BEST MODE FOR CARRYING OUT THE INVENTION

Hereinafter, with reference to the drawings, various embodiments of the present invention will be described.

(First Embodiment)

Figure 1:
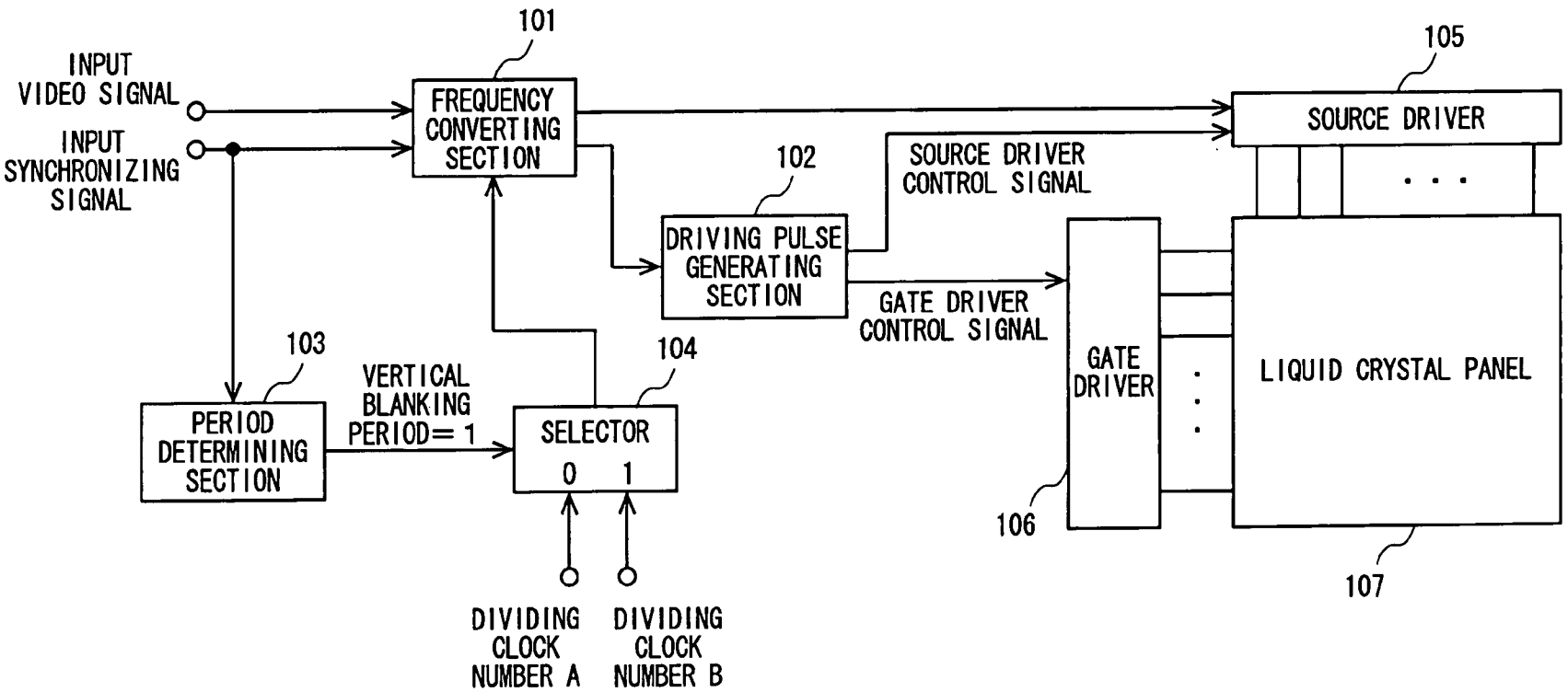
FIG. 1 is a block diagram showing the structure of a liquid crystal display apparatus according to a first embodiment of the present invention.

In FIG. 1, the structure of a liquid crystal display apparatus according to a first embodiment of the present invention is shown. In FIG. 1, the liquid crystal display apparatus includes a frequency converting section 101, a driving pulse generating section 102, a period determining section 103, a selector 104, a source driver 105, a gate driver 106, and a liquid crystal panel 107. Here, the liquid crystal panel 107 operates in OCB mode.

To the liquid crystal display apparatus, an input video signal and a corresponding input synchronizing signal (including a horizontal synchronizing signal and a vertical synchronizing signal) are supplied. The period determining section 103 determines a vertical blanking period based on the input synchronizing signal. Based on the determination results by the period determining section 103, the selector 104 selects a dividing clock number (a dividing clock number A for the vertical blanking period or a dividing clock number B for other interval), and supplies it to the frequency converting section 101. The frequency converting section 101 performs a frequency converting process for the input video signal and the input synchronizing signal, and further inserts, at predetermined intervals, anon-image signal (a signal for applying a high voltage to OCB cells in order to prevent a back-transition) between image signals (video signal corresponding to one line) included in the input video signal. Note that, in the present embodiment, it is assumed that the frequency converting section 101 performs 1.25 times frequency conversion, and generates an output video signal by inserting one non-image signal foe every four image signals.

Figure 2:
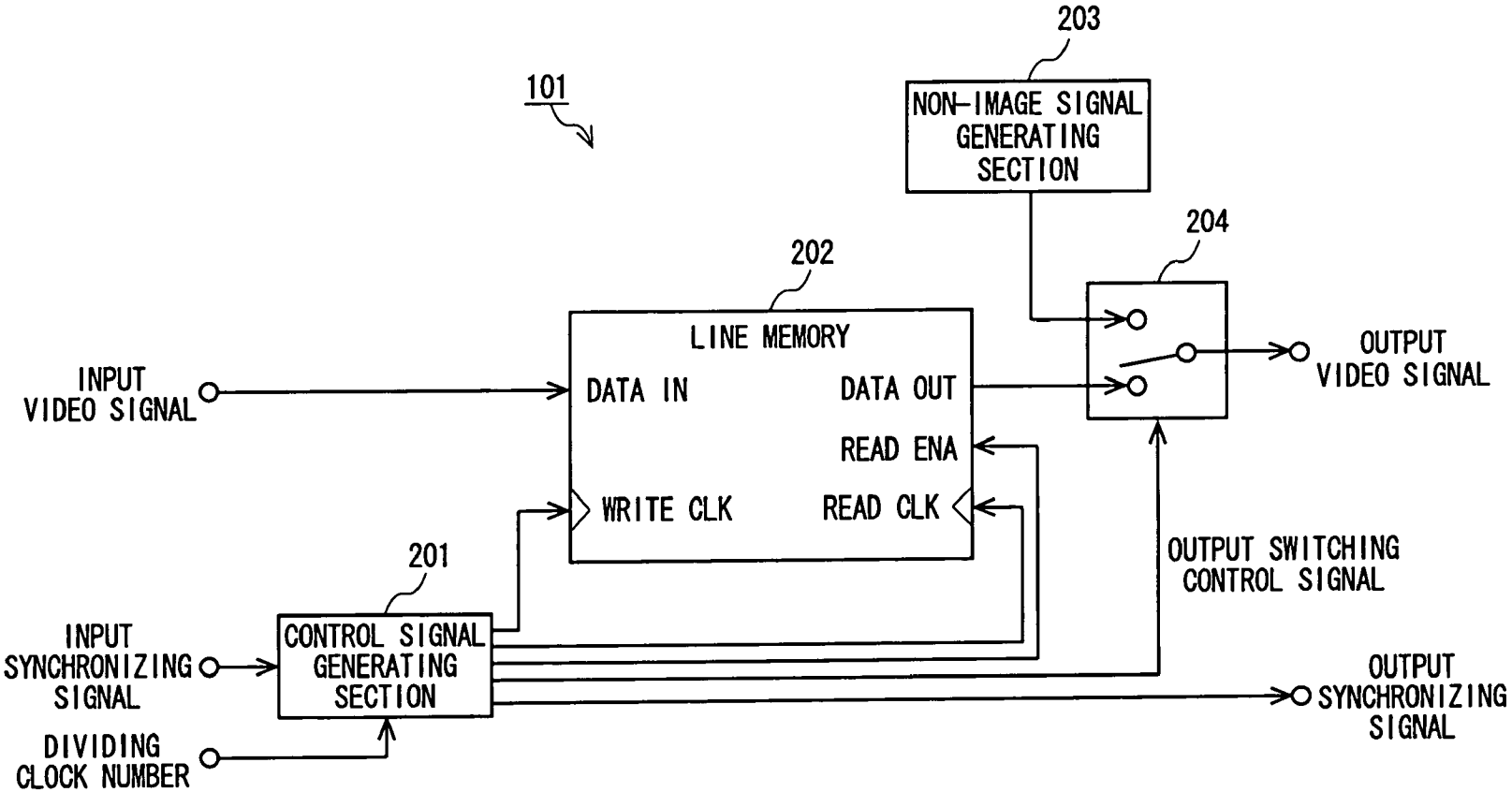
FIG. 2 is a block diagram showing the structure of a frequency converting section.

In FIG. 2, the structure of the frequency converting section 101 is shown. A line memory 202 temporarily stores an image signal corresponding to one line. A control signal generating section 201 generates various control signals based on the input synchronizing signal and the dividing clock number selected by the selector 104. Specifically, the control signal generating section 201 generates a writing clock (WRITE CLK) for controlling a timing of writing each image signal of the input video signal into the line memory 202, a reading clock (READ CLK) for controlling a timing of reading the image signal stored in the line memory 202, a read enable signal (READ ENA) allowing reading of data from the line memory 202, an output switching control signal for controlling a selecting operation of an output signal selecting section 204, and an output synchronizing signal which is a synchronizing signal corresponding to a video signal after frequency conversion (output video signal). A non-image signal generating section 203 outputs a non-image signal. The output signal selecting section 204 alternately selects an output of the line memory 202 and an output of the non-image signal generating section 203, based on the output switching control signal from the control signal generating section 201, and outputs it as an output video signal. A writing process and a reading process into/from the line memory 202 are similar to those shown in FIG. 29.

Hereinafter, for the sake of simplicity of the descriptions, a specific operation of the liquid crystal display apparatus will be described, by taking an exemplary case in which the number of horizontal scanning periods composing one frame period in an input video signal is 50 (among these, the number of horizontal scanning periods in an active video period is 40, and the number of horizontal scanning periods in a vertical blanking period is 10). Note that it is assumed that one frame period is 20 ms.

In this case, if 1.25 times frequency conversion is simply performed for the input video signal, the number of horizontal scanning periods composing one frame period in the output video signal becomes 50×1.25=62.5, which is not an odd multiple of (L+1) (note that, in the present embodiment, L=4). As a result, irregularity of brightness occurs. For that reason, during the active video period, the frequency converting section 101 changes the number of horizontal scanning periods in the active video period from 40 to 50, and changes the number of horizontal scanning periods in the vertical blanking period from 10 to 15. As a result, the number of horizontal scanning periods composing one frame period in the output video signal becomes 50+15=65, which is an odd multiple of (L+1).

In order to realize the above-described operation of the frequency converting section 101, in the present embodiment, a different dividing clock number is used in the active video period and in the vertical blanking period.

Assume that a horizontal dot clock number of the input video signal is 100, a frequency of the writing clock of the line memory 202 becomes 100×50/0.02=250 kHz. In the frequency converting section 101, 1.25 times frequency conversion is performed, and a frequency of the reading clock of the line memory 202 becomes 250×1.25=312.5 kHz.

The active video period is 20×40/50=16 ms, and the number of horizontal scanning periods included in the active video period in the output video signal is 50, whereby the necessary dividing clock number in the active video period is 312.5×16/50=100.

On the other hand, the vertical blanking period is 20×10/50=4 ms, and the number of horizontal scanning periods included in the vertical blanking period in the output video signal is 15, whereby the necessary dividing clock number in the vertical blanking period is 312.5×4/15=83 (fractional portion is truncated) Here, for the sake of simplicity of the descriptions, it is assumed that the fractional portion is truncated, but frequency division may be performed while keeping decimal precision (a method thereof is well-known, and therefore is not further described).

Figure 3:
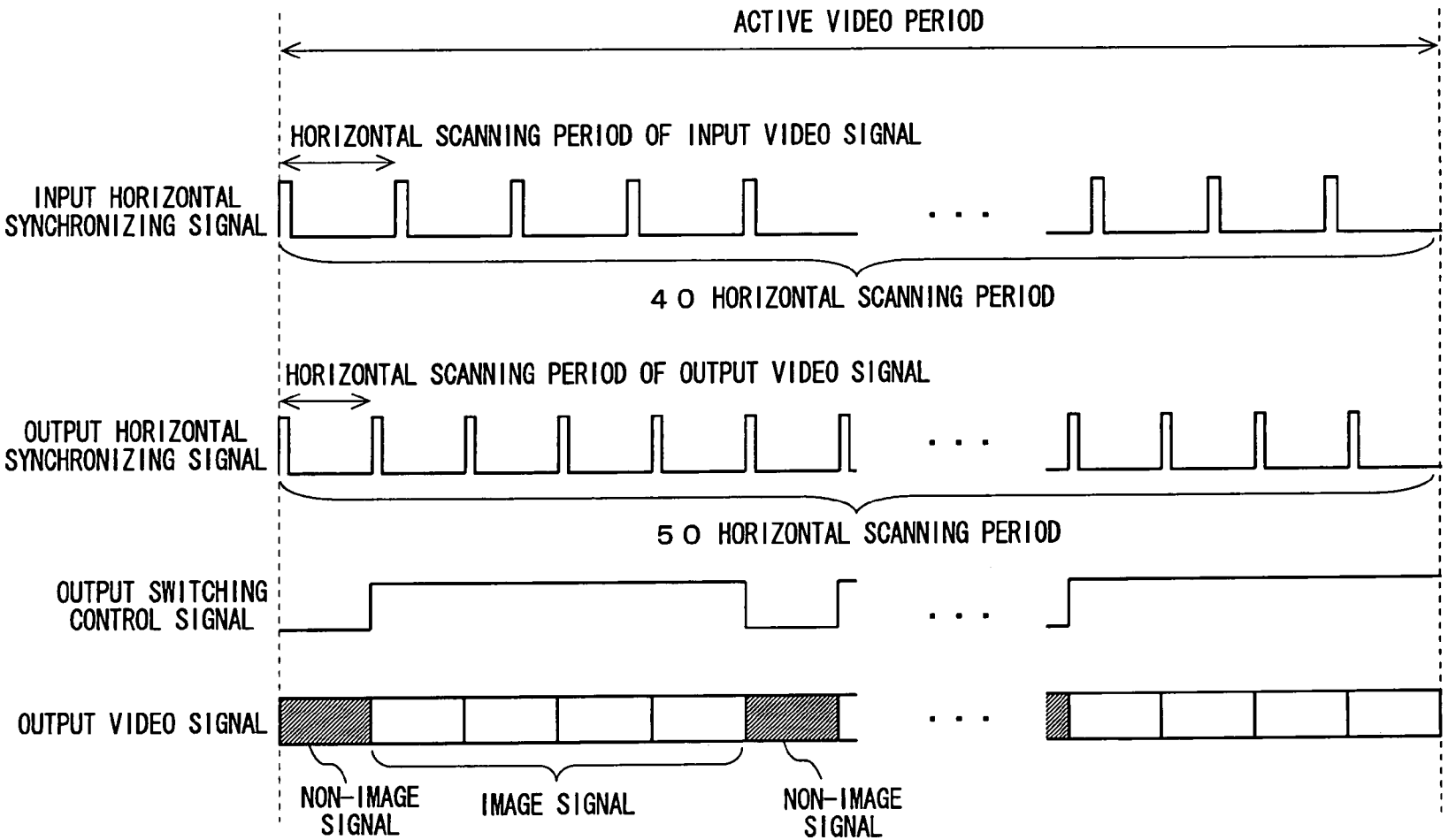
FIG. 3 is an illustration showing an operation of the frequency converting section during an active video period.
Figure 4:
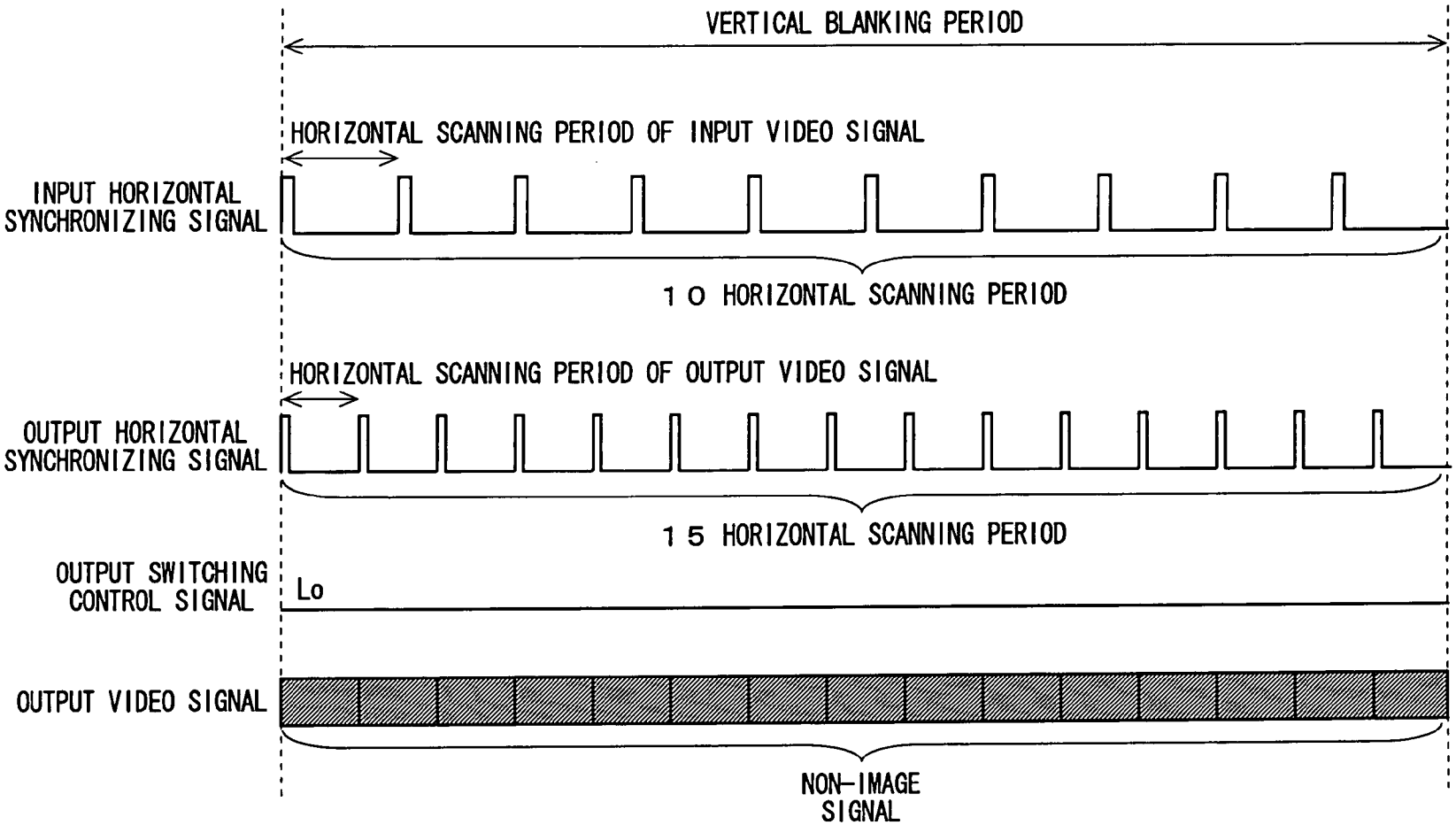
FIG. 4 is an illustration showing an operation of the frequency converting section during a vertical blanking period.
Figure 5:
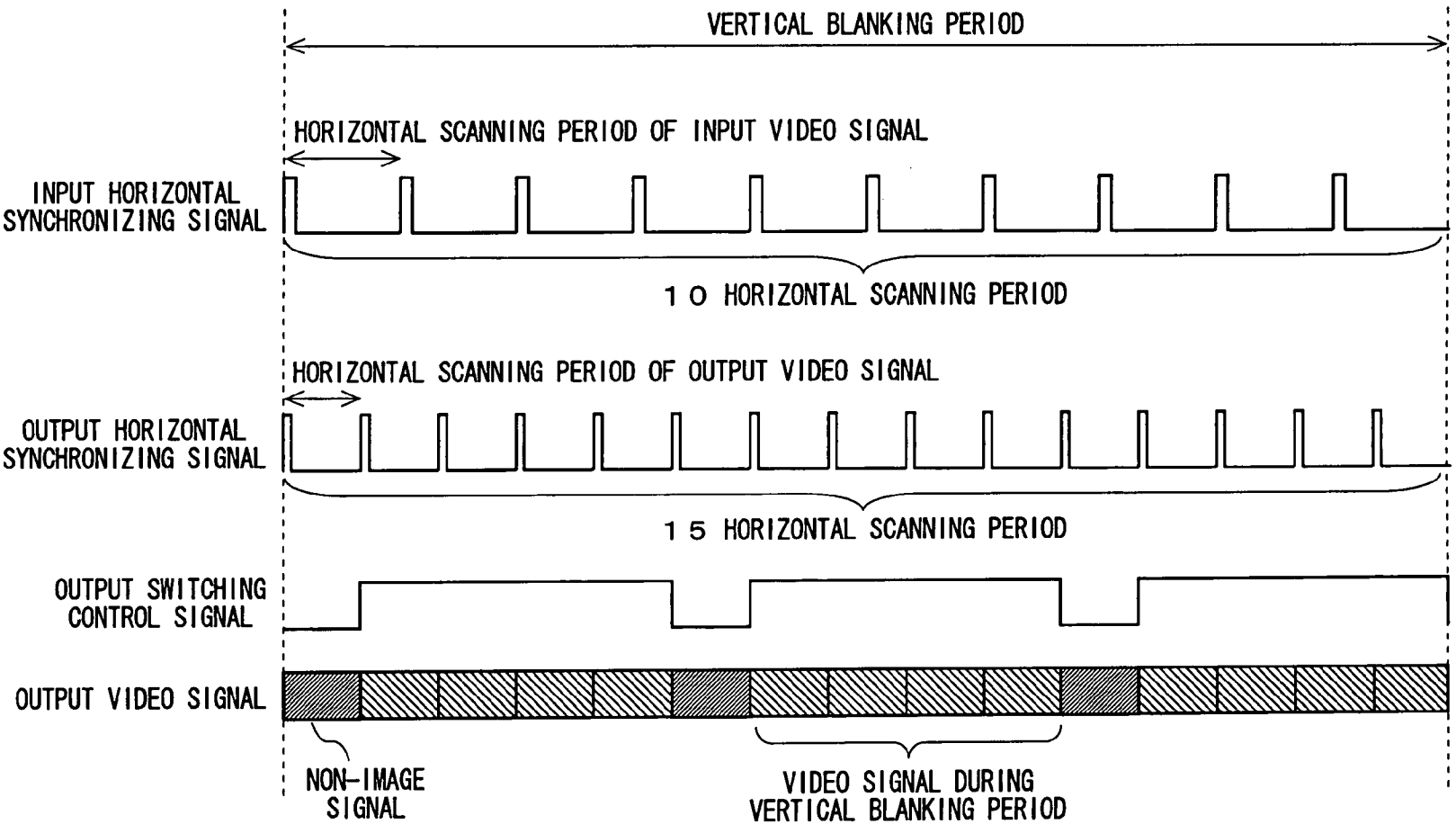
FIG. 5 is an illustration showing an operation of the frequency converting section during a vertical blanking period.

That is, what is needed is to previously set the dividing clock number A and the dividing clock number B, as shown in FIG. 1, at 100 and 83, respectively. The selector 104 selects the dividing clock number A (100) for the active video period, and selects the dividing clock number B (83) for the vertical blanking period. The control signal generating section 201 of the frequency converting section 101 generates an output synchronizing signal and an output video signal, based on the dividing clock number supplied from the selector 104, for outputting. Signal waveforms indicating such operation of the frequency converting section 101 are shown in FIGS. 3 and 4. Especially, FIG. 3 shows an operation in the active video period, and FIG. 4 shows an operation in the vertical blanking period. Note that, in FIG. 4, the output signal selecting section 204 always selects an output of the non-image signal generating section 203, but may alternately select an output of the line memory 202 and an output of the non-image signal generating section 203, as shown in FIG. 5. The reason is that, in the present embodiment, any portion other than the non-image signal, which is included in the output video signal as shown in FIG. 4, is not written into the pixels of the liquid crystal panel 107, thereby having no effect on the display.

Figure 6:
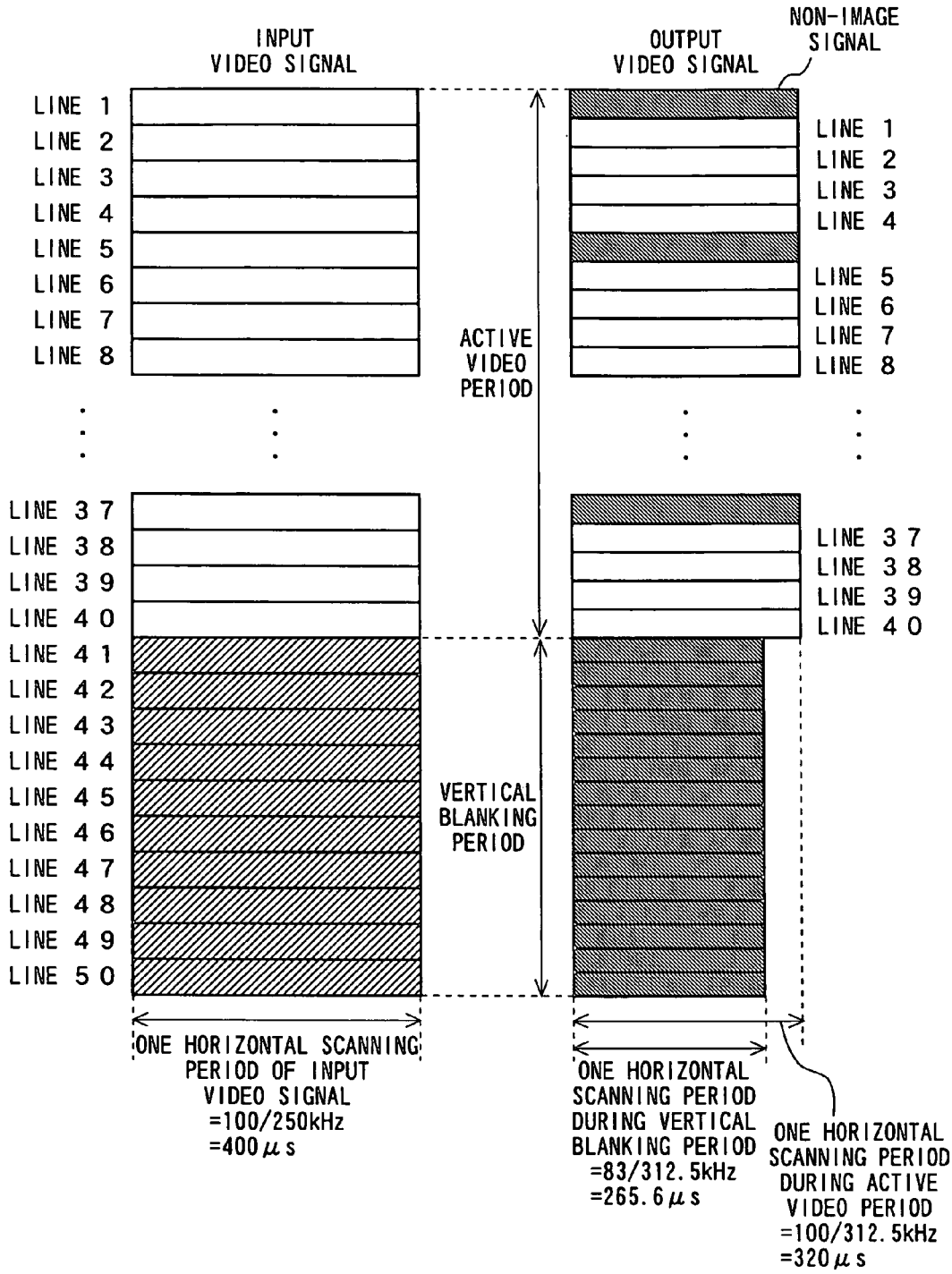
FIG. 6 is an illustration showing a relation between horizontal scanning periods before and after frequency conversion.
Figure 7:
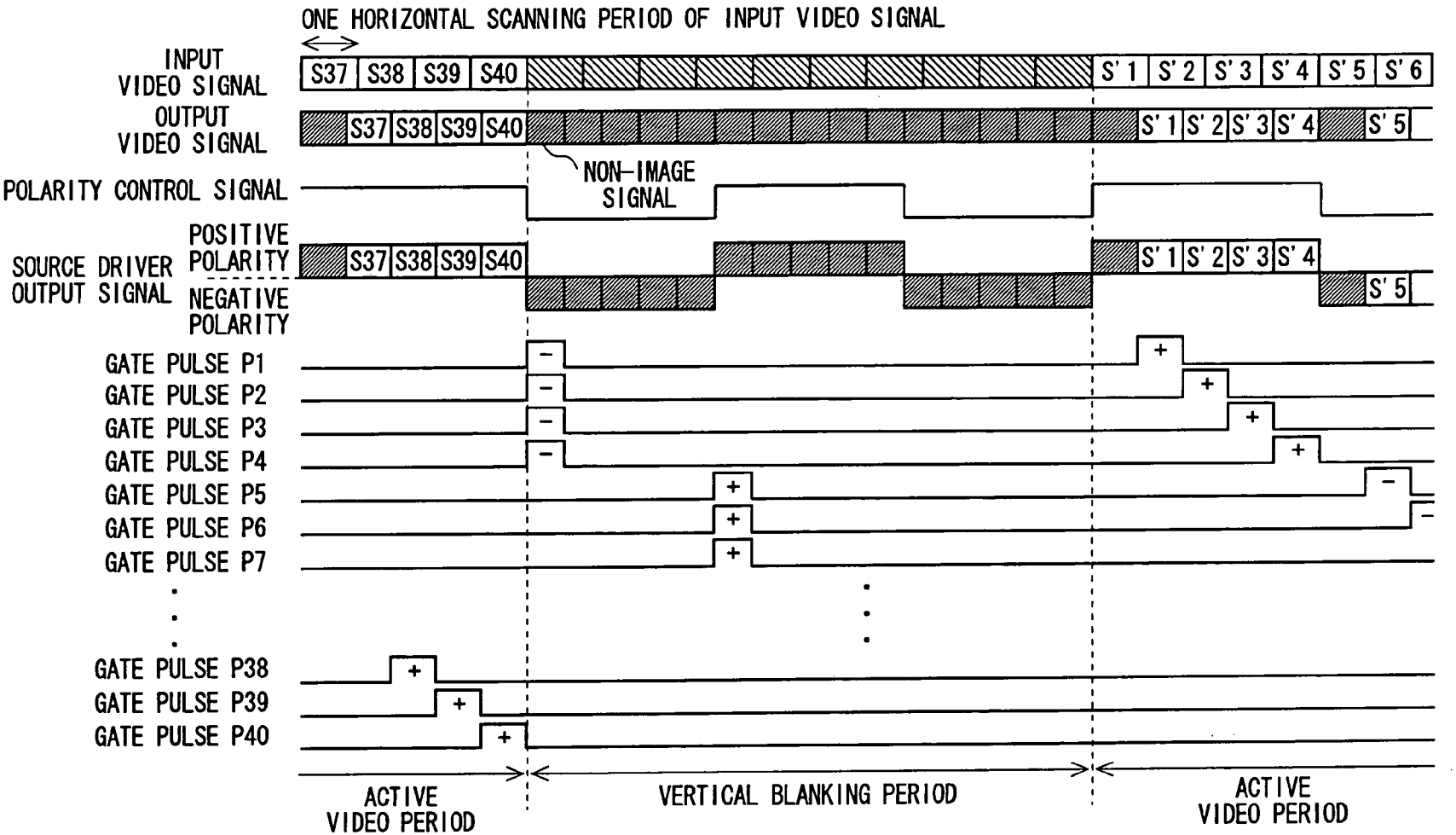
FIG. 7 is an illustration showing outputs of a source driver and a gate driver.

In FIG. 6, a relation between horizontal scanning periods before and after frequency conversion is shown. During the active video period, the number of horizontal scanning periods is changed from 40 to 50. On the other hand, during the vertical blanking period, the number of horizontal scanning periods is changed from 10 to 15. As a result, the number of horizontal scanning periods composing one frame period in the output video signal becomes 65, which is an odd multiple of five (a number obtained by adding one to four, which is the number of lines into which a non-image signal is concurrently written). The output video signal generated as described above is supplied to the source driver 105, and written into pixels on a predetermined gate line based on the gate pulse output from the gate driver 106. FIG. 7 shows an output signal of the source driver 105 and an output signal (gate pulse) of the gate driver 106 from an active video period of a given frame to an active video period of the following frame through a vertical blanking period. In the example of FIG. 7, a non-image signal is written into each pixel before an image signal is written thereinto (before 16 through 19 horizontal scanning periods), and the non-image signal is held during 16 through 19 horizontal scanning periods (that is, on the average, a period corresponding to 27% of one frame period).

Figure 8:
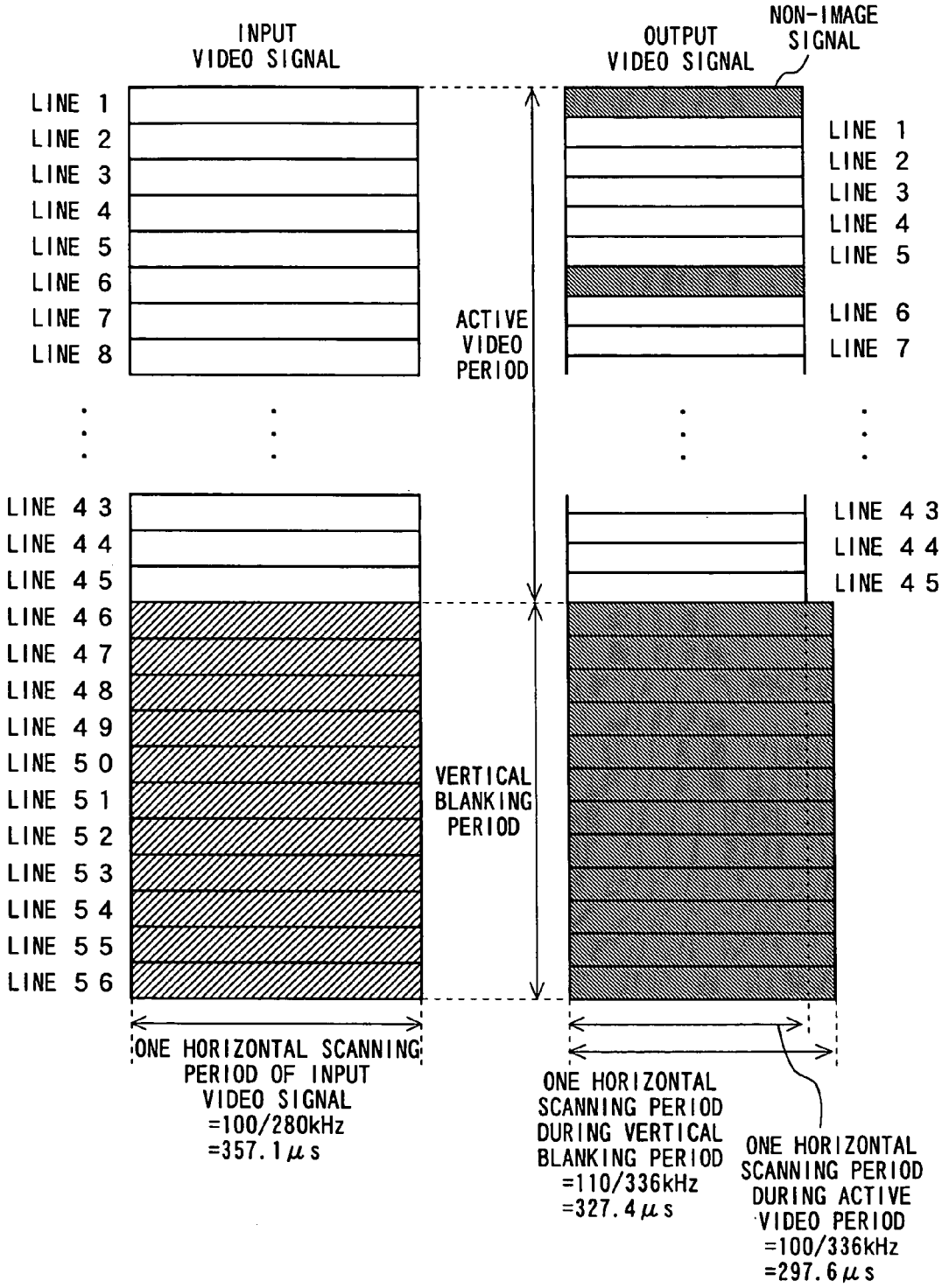
FIG. 8 is an illustration showing a relation between horizontal scanning periods before and after frequency conversion.

FIG. 8 shows, as another specific example, a relation between horizontal scanning periods before and after frequency conversion in a case where 1.2 times frequency conversion is performed for generating an output video signal by inserting one non-image signal for every five image signals (that is, a non-image signal is concurrently written into pixels on five gate lines) when the number of horizontal scanning periods composing one frame period in an input video signal is 56 (among these, the number of horizontal scanning periods in the active video period is 45, and the number of horizontal scanning periods in the vertical blanking period is 11). In this case, in order to prevent irregularity of brightness, the number of horizontal scanning periods composing one frame period in an output video signal has to be an odd multiple of six. In the example of FIG. 8, the number of horizontal scanning periods in the active video period is changed from 45 to 54, and the number of horizontal scanning periods in the vertical blanking period is changed from 11 to 12, whereby the number of horizontal scanning periods composing one frame period becomes 66 (odd multiple of six). In this case, what is needed is to previously set the dividing clock number A and the dividing clock number B, as shown in FIG. 1, at 100 and 110, respectively, and cause the selector 104 to select the dividing clock number A (100) and the dividing clock number B (110) for the active video period and the vertical blanking period, respectively.

As such, according to the first embodiment, the frequency converting section 101 generates an output video signal by inserting one non-image signal, which is to be concurrently written into pixels on L gate lines of the liquid crystal panel 107, for one line, between image signals composing the input video signal, for corresponding L lines, and adjusting the number of horizontal scanning periods of the output video signal so that a number of horizontal scanning periods composing one frame period is (L+1)×(2N+1) (N is an integer). Therefore, irregularity of brightness does not occur even in a case where a non-image signal is regularly inserted and AC driving is performed for the liquid crystal panel 107.

Figure 29:
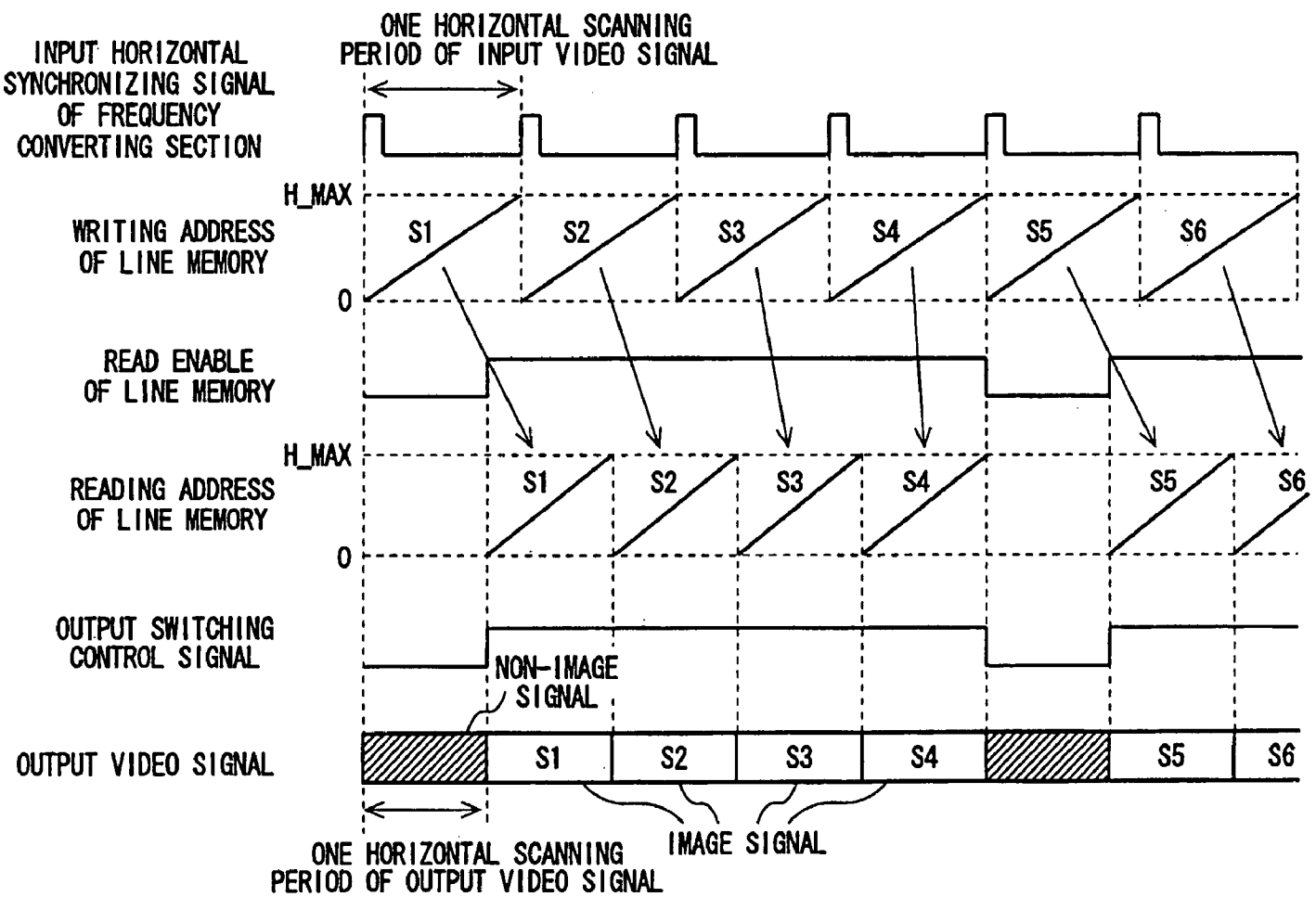
FIG. 29 PRIOR ART
FIG. 29 is an illustration showing an operation of the frequency converting section.
Figure 30:
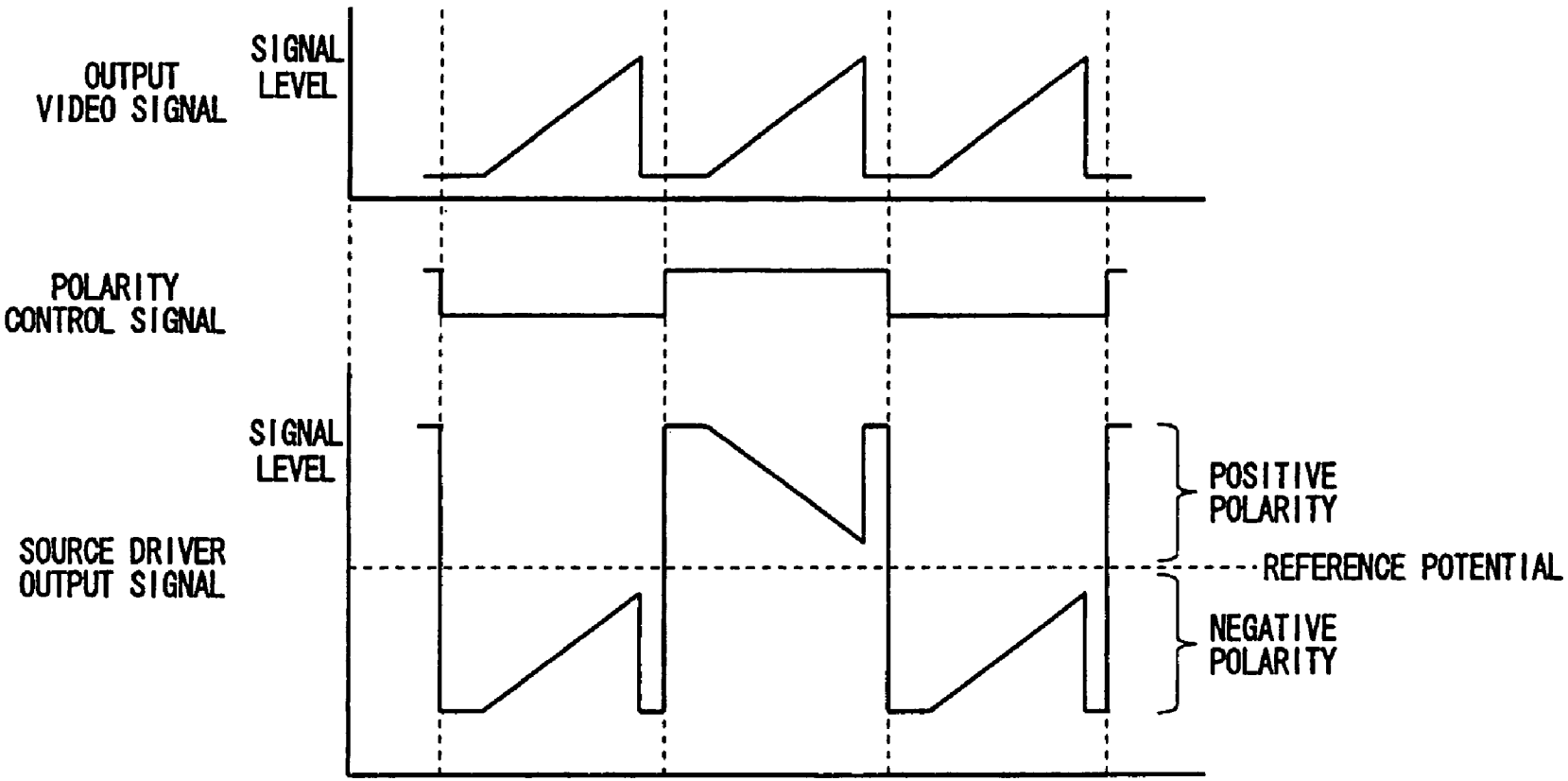
FIG. 30 PRIOR ART
FIG. 30 is an illustration showing a relation between a polarity control signal and an output of the source driver.
Figure 31:
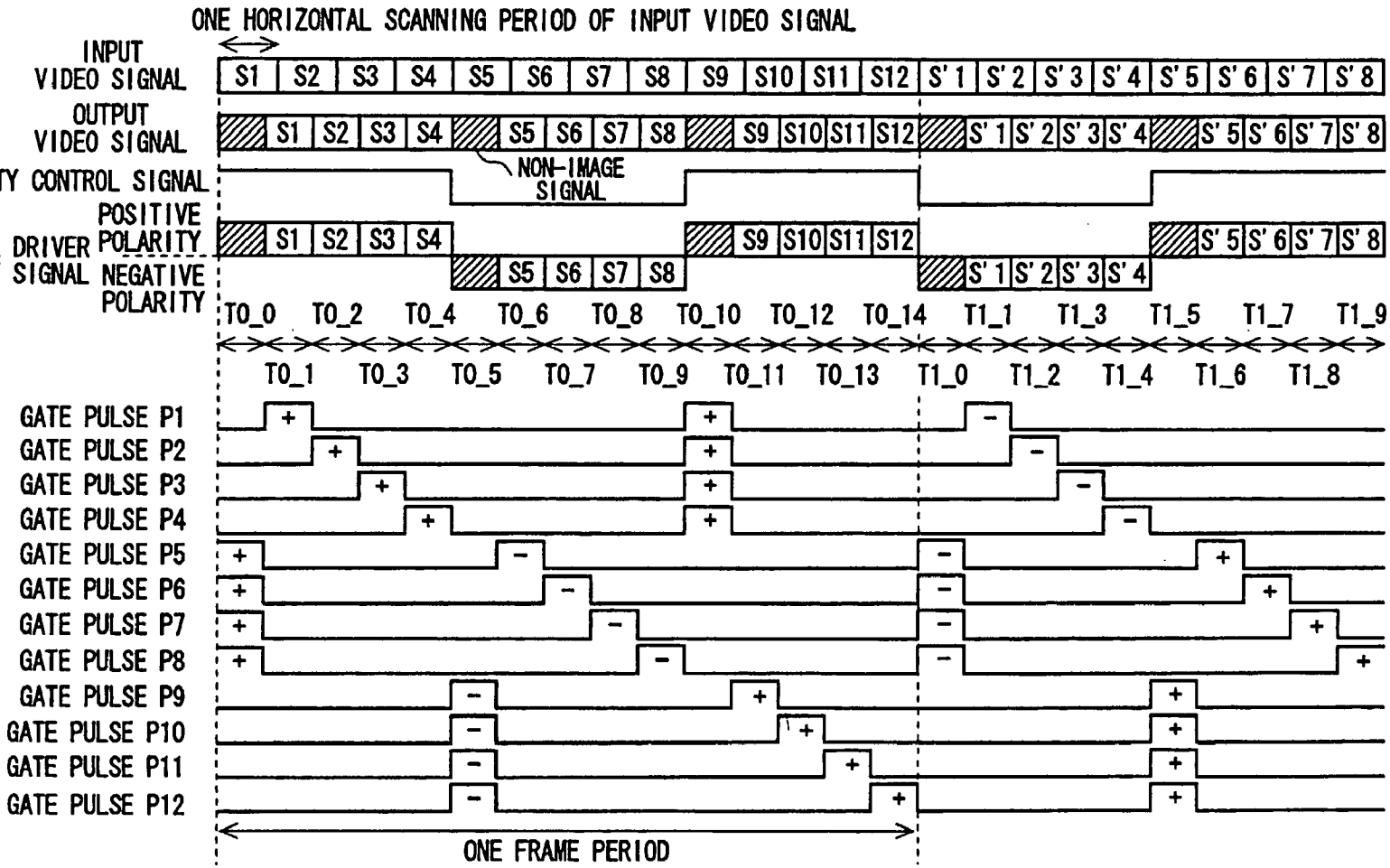
FIG. 31 PRIOR ART
FIG. 31 is an illustration showing outputs of the source driver and the gate driver.
Figure 32:
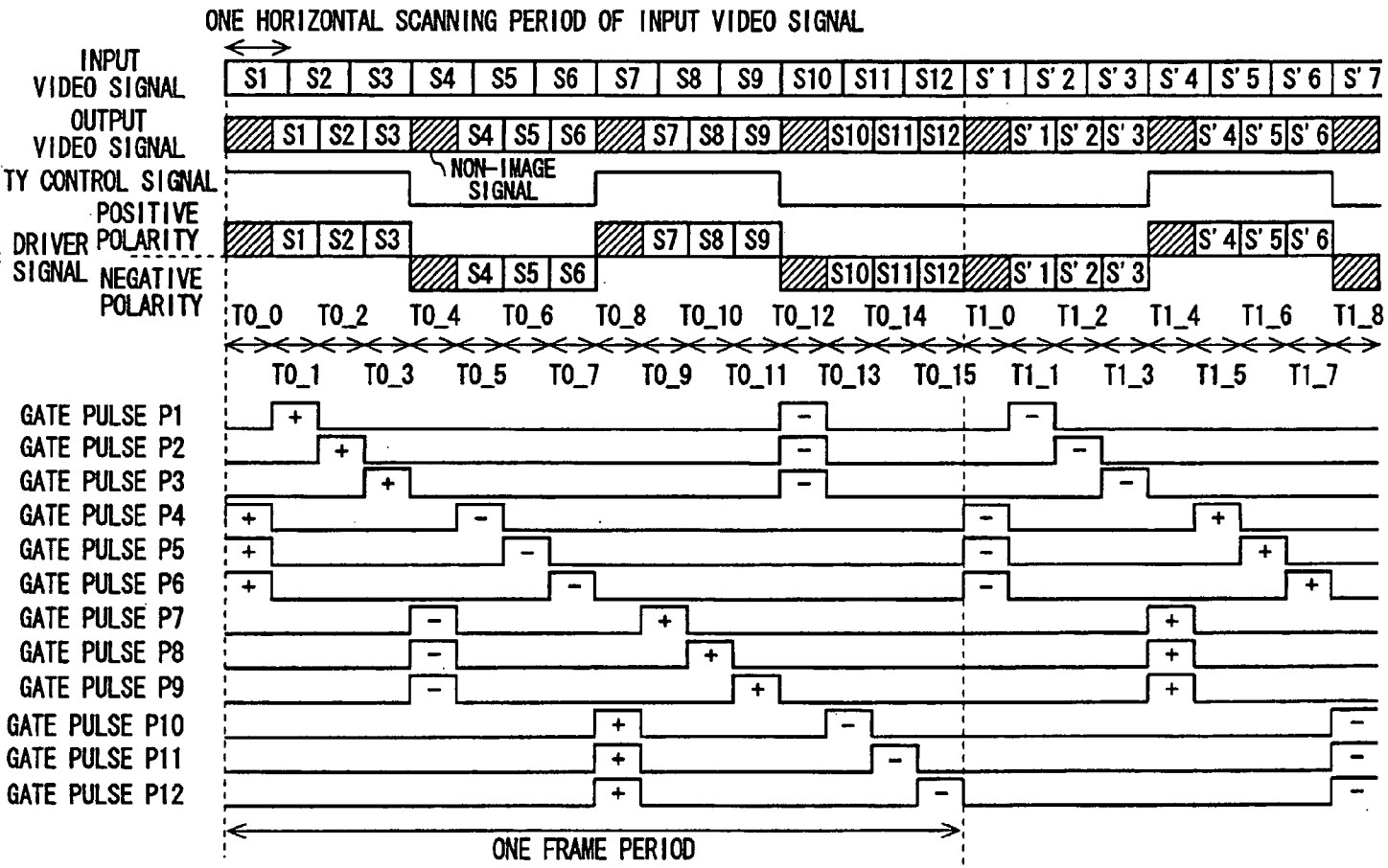
FIG. 32 PRIOR ART
FIG. 32 is an illustration showing outputs of the source driver and the gate driver.

Note that, in the first embodiment, frequency conversion is performed in the usual way during the active video period, and the number of horizontal scanning periods in the vertical blanking period is increased/decreased so that the number of horizontal scanning periods composing one frame period is adjusted to be (L+1)×(2N+1). Now, in a case where the number of horizontal scanning periods in the active video period is adjusted, there is a possibility that an increase of the number of horizontal scanning periods in the active video period causes a time lag between writing and reading of an image signal into/from the line memory 202 as shown in FIG. 29. Therefore, the line memory 202 for one line may be insufficient for proper transfer of an image signal. However, as described in the present embodiment, in a case where the number of horizontal scanning periods in the vertical blanking period is increased/decreased, writing and reading timing of an image signal into/from the line memory 202 during the active video period is not affected, whereby it is possible to freely increase/decrease the number of horizontal scanning periods without adding another line memory. Note that, due to a non-image signal written into pixels of the liquid crystal panel 107 during the vertical blanking period as shown in FIG. 7, it is not recommended to increase/decrease the number of horizontal scanning periods in the vertical blanking period more than necessary. The reason is that a writing time of the non-image signal loses its balance, which results in the occurrence of irregularity of brightness. Thus, as long as a condition that the number of horizontal scanning periods composing one frame period is (L+1)×(2N+1) (N is integer) is satisfied, it is preferable to minimize a range of increase/decrease of the number of horizontal scanning periods in the vertical blanking period. Note that a third embodiment, which will be described below, prevents a balance of a writing time of the non-image signal from being lost due to the above-described adjustment of the number of horizontal scanning periods.

Note that, in the first embodiment, the descriptions have been given on the assumption that the number of horizontal scanning periods composing one frame period in the input video signal is previously determined. However, the number of horizontal scanning periods composing one frame period can be determined in accordance with a format of a video signal (for example, 750P, 1125i, and NTSC). Therefore, the structure shown in FIG. 1 cannot support a plurality of formats. What is needed to support a plurality of formats is, for example, to store a combination of the dividing clock number A and the dividing clock number B in a table on a format basis, and read the combination of the dividing clock number A and the dividing clock number B from the table, in accordance with the format of the input video signal, for supplying it to the selector 104.

(Second Embodiment)

Now, the number of horizontal scanning periods composing one frame period in an input video signal dynamically fluctuates in some cases. Research performed by the inventors of the present invention reveals that the number of horizontal scanning periods composing one frame period dynamically fluctuates in accordance with a reproducing speed in a case where, for example, a video signal of an analog VTR is reproduced at high speed. Especially, a reproducing speed sharply fluctuates on a frame basis during a transition period from normal reproduction to high-speed reproduction, or a transition period from high-speed reproduction to normal reproduction. Hereinafter, as a second embodiment, a liquid crystal display apparatus capable of handling such a case will be described.

Figure 9:
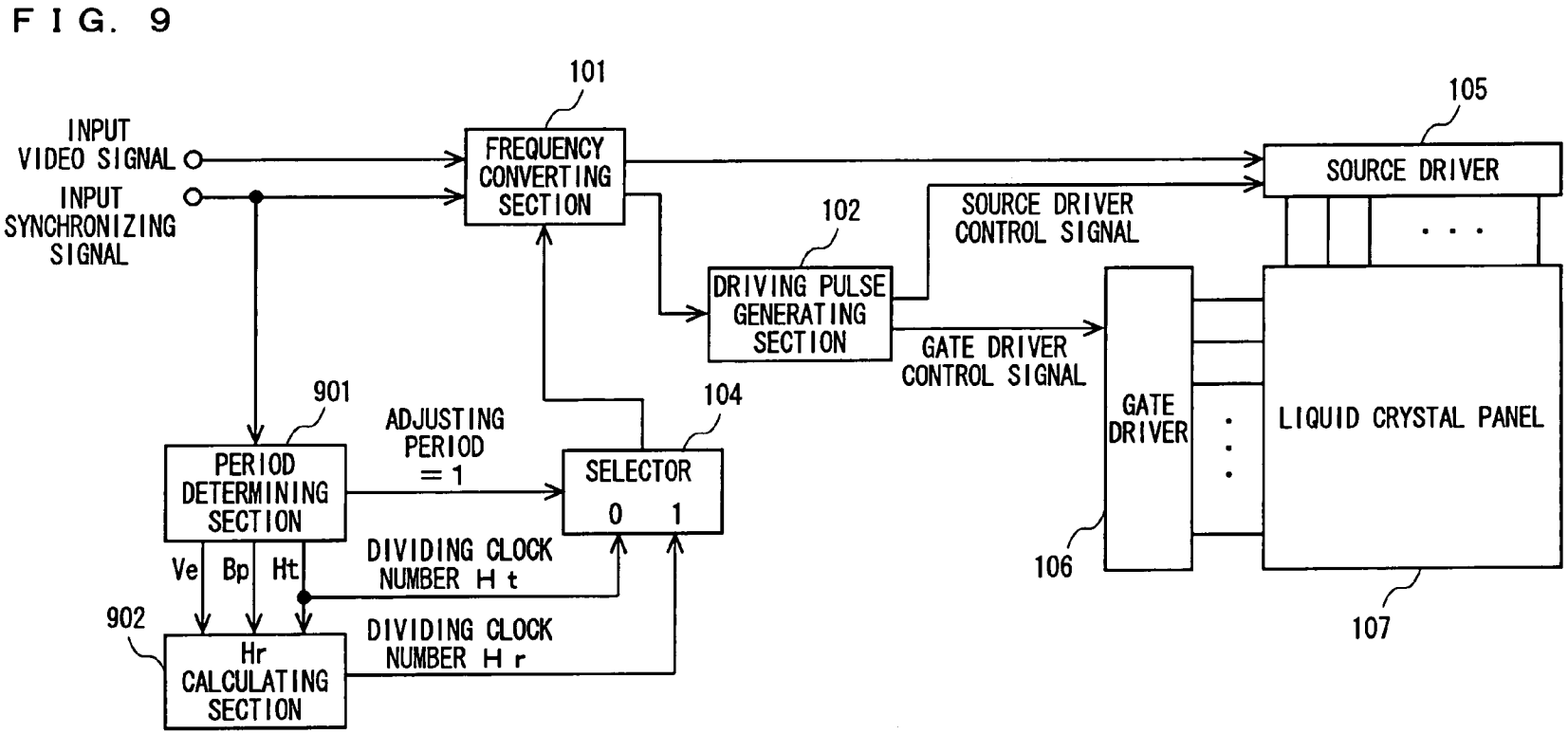
FIG. 9 is a block diagram showing the structure of a liquid crystal display apparatus according to a second embodiment of the present invention.

In FIG. 9, the structure of the liquid crystal display apparatus according to the second embodiment of the present invention is shown. In FIG. 9, the liquid crystal display apparatus includes the frequency converting section 101, the driving pulse generating section 102, the selector 104, the source driver 105, the gate driver 106, the liquid crystal panel 107, a period determining section 901, and an Hr calculating section 902. Note that any component elements in FIG. 9 similar to those in FIG. 1 are denoted by like numerals, with the descriptions thereof omitted.

In the present embodiment, the number of horizontal scanning periods is individually adjusted in real time on a frame period basis by taking advantage of the fact that a time period from input of a vertical synchronizing pulse to start of the active video period is unchanged even in a case where, like an analog VTR, the number of horizontal scanning periods composing one frame period dynamically fluctuates. First, with reference to FIG. 10, a process of the present embodiment is described on a conceptual basis.

Figure 10:
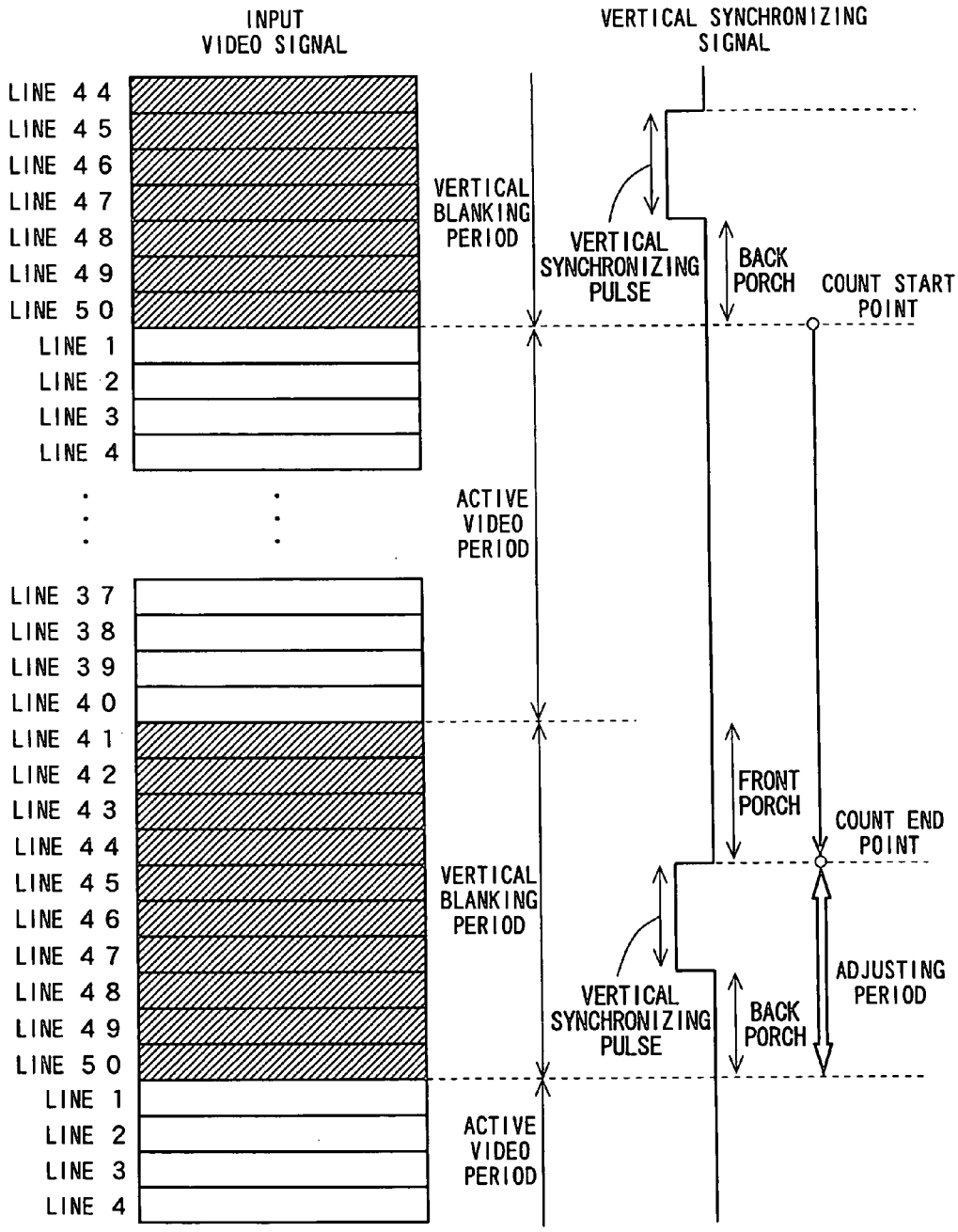
FIG. 10 is an illustration for describing a principle of the second embodiment.

In order to perform real time adjustment for the number of horizontal scanning periods of a video signal whose number of horizontal scanning periods composing one frame period dynamically fluctuates, in the present embodiment, as shown in FIG. 10, the number of horizontal scanning periods existing during a period from a start of the active video period to an input of the vertical synchronizing pulse is counted. Then, in accordance with the number, the number of horizontal scanning periods included in a period (adjusting period in the drawing) from completion of counting to a start of the active video period is adjusted so that the number of horizontal scanning periods composing one frame period in the output video signal becomes an odd multiple of (L+1). Note that a time from an input of the vertical synchronizing pulse to a start of the active video period is fixed on a video signal format basis, whereby it is possible to make a sufficiently accurate prediction about the point of time. By repeatedly performing the above-described process for each frame, it is possible to handle a video signal whose number of horizontal scanning periods composing one frame period dynamically fluctuates.

Figure 11:
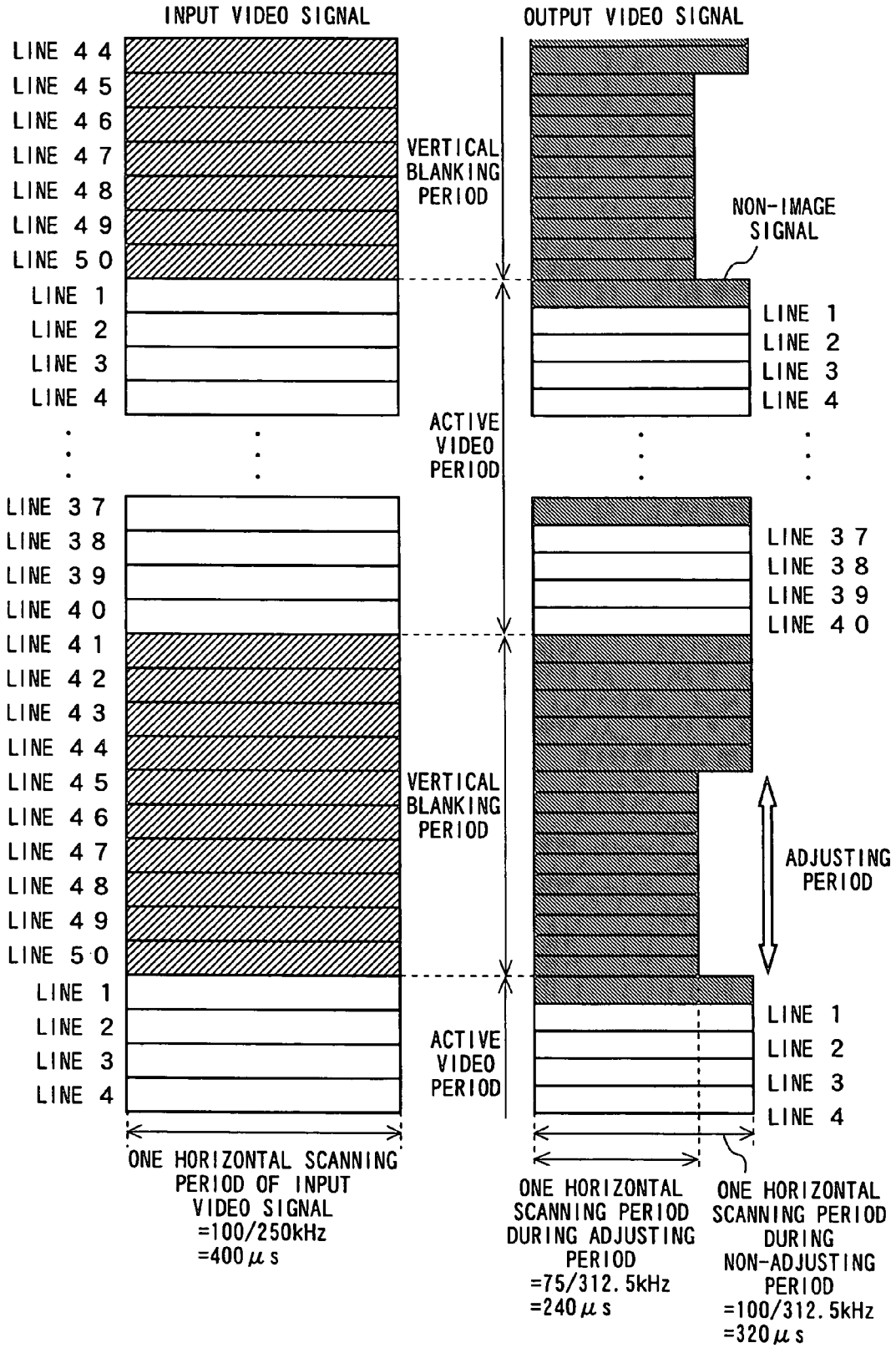
FIG. 11 is an illustration showing a relation between horizontal scanning periods before and after frequency conversion.

In FIG. 11, a relation between horizontal scanning periods before and after frequency conversion, in a case where 1.25 frequency conversion is performed and one non-image signal is inserted for every four image signals for generating an output video signal is shown. In order to realize the above process, the present embodiment supplies, to the frequency converting section 101, a dividing clock number in the adjusting period, and a different clock number in other period. Especially, the dividing clock number corresponding to the adjusting period is calculated in real time based on the above-described counting results of the number of horizontal scanning periods. These processes are executed by the period determining section 901, the Hr calculating section, and the selector 104, which are shown in FIG. 9. Hereinafter, operations thereof will be described.

The period determining section 901 determines, based on the input synchronizing signal, whether or not a signal currently input into the frequency converting section 101 is one corresponding to the adjusting period, and outputs the determination results to the selector 104. Specifically, the determination is made that a period from an input of the vertical synchronizing pulse to a start of the active video period is the adjusting period. Furthermore, the period determining section 901 counts the number Ve of horizontal scanning periods during a period from a start of the active video period to an input of the vertical synchronizing pulse (that is, from a start of counting to an end of counting shown in FIG. 10), and outputs it to the Hr counting section 902. Also, the period determining section 901 obtains the number Bp of horizontal scanning periods included in a period from an input of the vertical synchronizing pulse to a start of the active video period from the table or externally, and output sit to the Hr counting section 902. Note that, with respect to a portion of video signals such as a high-speed reproducing signal of the analog VTR, the number Bp of horizontal scanning periods in a period from an input of the vertical synchronizing pulse to a start of the active video period dynamically fluctuates due to, for example, insertion of a pseudo-horizontal synchronizing pulse. However, following descriptions will reveal that the number of horizontal scanning periods can be properly adjusted by utilizing, as appropriate, a predetermined set value of normal reproduction thanks to a fixed length (length of time) of a back porch period. Also, the period determining section 901 outputs, to the selector 104 and the Hr calculating section 902, a horizontal dot clock number of the input video signal as a dividing clock number Ht. The above-described functions of the period determining section 901 can be realized by, for example, a video signal processor.

The Hr calculating section 902 calculates a dividing clock number Hr used for the adjusting period based on values of Ve, Bp, and Hr, which are supplied from the period determining section 901. Assume that a function F (x,n) is defined as a function returning a value closest to x among values of odd multiple of n, Hr is calculated as follows. Note that L is the number of gate lines into which a non-image signal is concurrently written.

$$Vr=F(Ve+Bp,L)$$

$$Hr=Bp/(Vr-Ve)\times Ht$$

As a result, for instance, Hr=75 in the example of FIG. 11.

As hardware realizing the function F, various structures are possible. In a case where n=4 (that is, in a case where L=4), the function F (x,4) can be represented as follows. Note that int (x) is a function returning an integer which does not exceed x.

$$F(x,4)=int(x/8)\times 8+4$$

Figure 12:
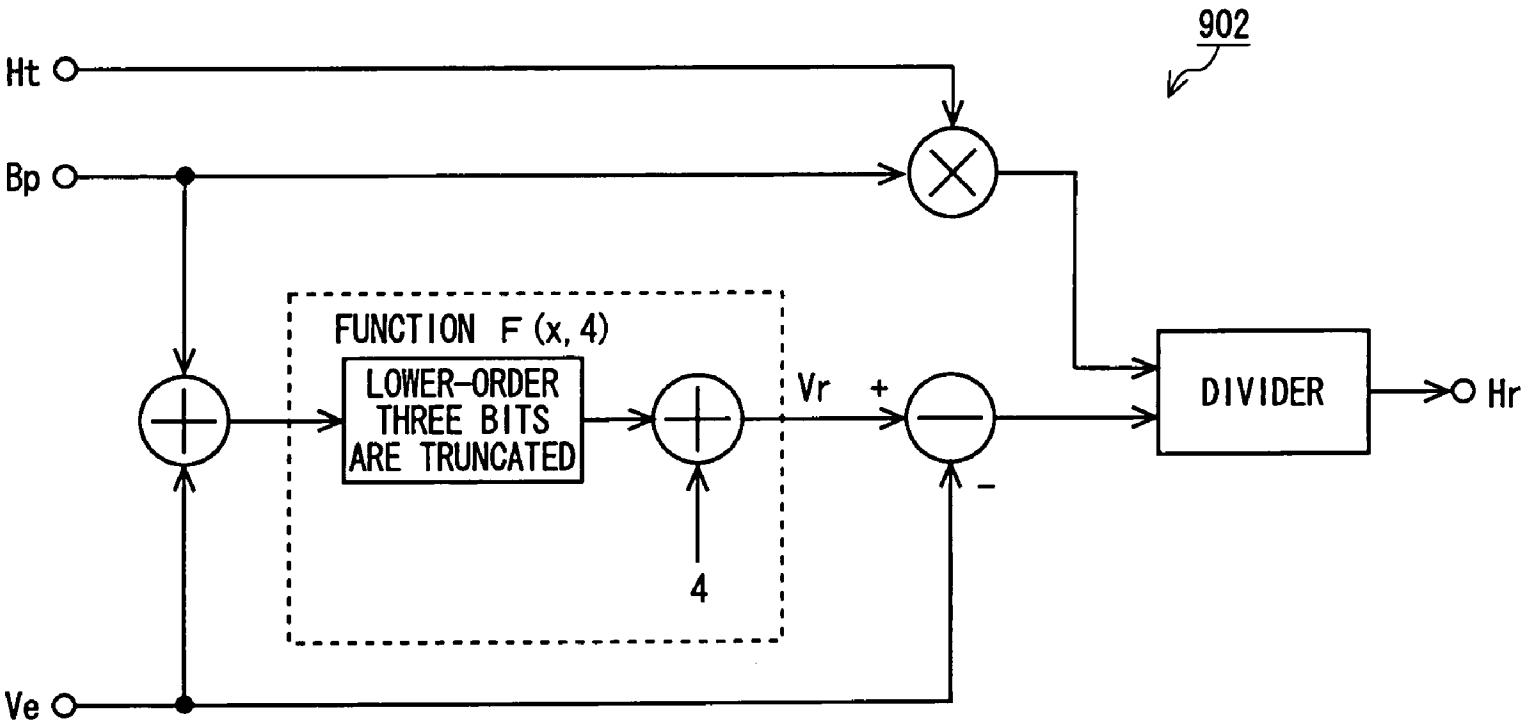
FIG. 12 is a block diagram showing the structure of an Hr calculating section.

In this case, int (x/8)×8 can be easily realized by truncating lower-order three bits, whereby it is possible to realize the Hr calculating section 902 using an extremely simple structure as shown in FIG. 12. Note that, in general, various structures are used as a divider, and therefore an optimum structure has to be selected in view of a calculating speed or the size of a circuit. In the present embodiment, a structure in which subtraction is repeated is not suitable due to slow calculation, and since calculation has to be ended in a time sufficiently shorter than at least the adjusting period (preferably, in a time sufficiently shorter than one horizontal scanning period). Therefore, a Newton-Raphson method, a written calculation procedure, and a table lookup are preferable.

Based on the determination results of the period determining section, the selector 104 selects the dividing clock number Hr output from the Hr calculating section 902 and supplies it to the frequency converting section 101 during the adjusting period, and selects the dividing clock number Ht output from the period determining section 901 and supplies it to the frequency converting section 101 during a period other than the adjusting period. The frequency converting section 101 generates an output video signal based on the dividing clock number supplied from the selector 104.

As such, according to the second embodiment, it is possible to perform real-time adjustment for the number of horizontal scanning periods of the input video signal, whereby irregularity of brightness does not occur, as is the case with the first embodiment, even in a case of handling a video signal whose horizontal scanning periods composing one frame period dynamically fluctuates.

Note that, in the second embodiment, it is assumed that the adjusting period is a period from an input of the vertical synchronizing pulse to a start of the active video period, but the present invention is not limited thereto. For example, only a back porch may be the adjusting period. However, the shorter the adjusting period becomes, the lower flexibility of adjustment becomes, whereby the adjusting period is preferably the longest possible period.

(Third Embodiment)

As described in the descriptions of the first embodiment, during the vertical blanking period, writing of the image signal is not performed, but the non-image signal is written into pixels of the liquid crystal panel 107 as shown in FIG. 7, whereby unnecessary increase/decrease of the number of horizontal scanning periods in the vertical blanking period causes a balance of a writing time of the non-image signal to be lost, which results in the occurrence of irregularity of brightness. For instance, in the example of FIG. 7, if the number of horizontal scanning periods in the vertical blanking period is increased, a length of one horizontal scanning period is relatively shortened, thereby reducing a writing time of the non-image signal. As a result, adequate writing of the non-image signal may become impossible, which results in a difference in brightness between an area into which the non-image signal is written during the vertical blanking period (in the example of FIG. 7, an area on the gate lines corresponding to the gate pulses P1 to P12) and an area into which the non-image signal is written during the active video period (an area on the gate lines corresponding to the gate pulses P13 to P40). Furthermore, a boundary of those areas always appears in the same location, where by even a slight difference of brightness can be easily noticed. The third embodiment is characterized in that fluctuations of the writing time of the non-image signal are prevented by controlling a length of the horizontal scanning period, into which the non-image signal is written during the vertical blanking period, so as to be the same length of the horizontal scanning period of the active video period.

Figure 13:
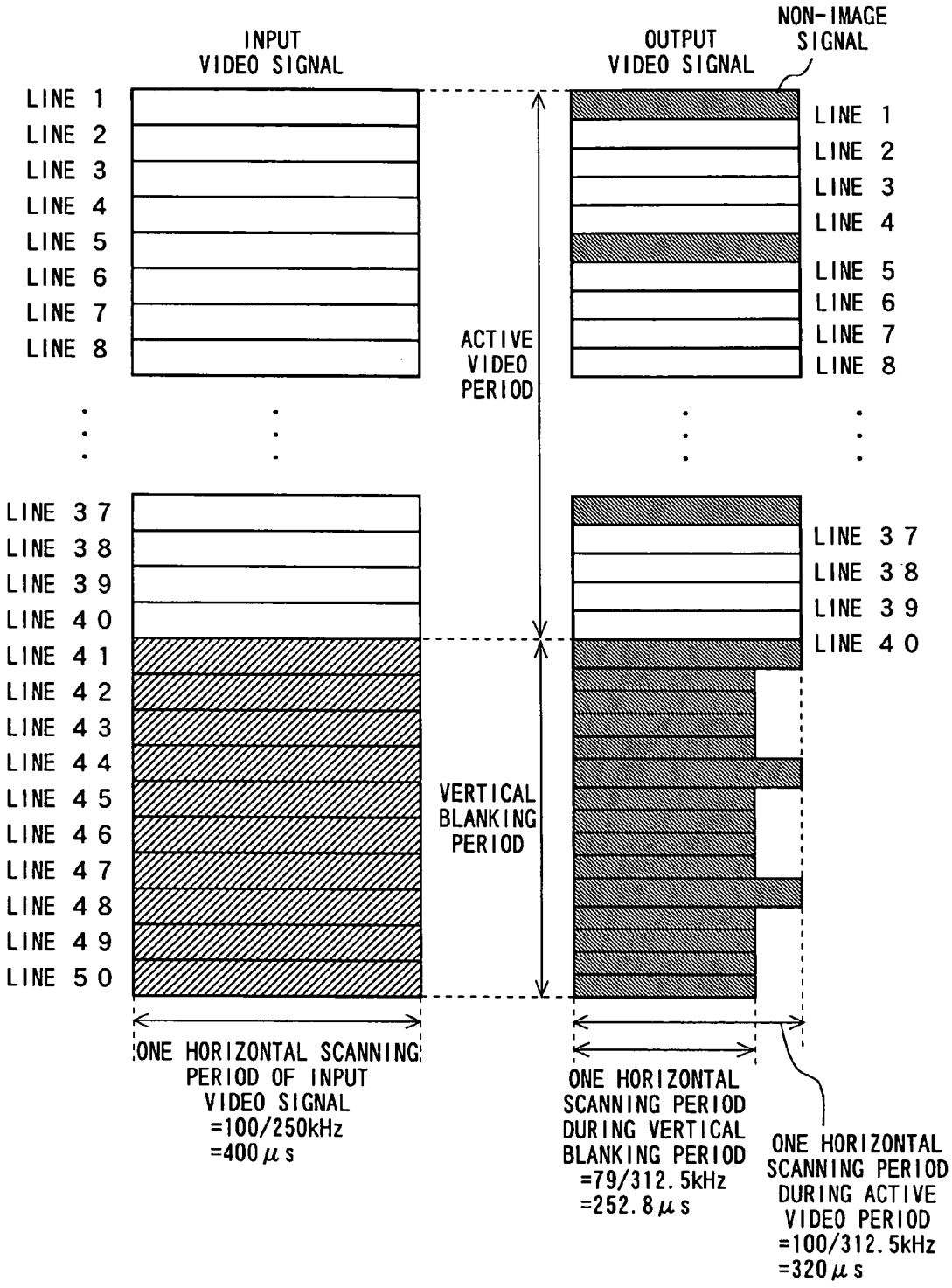
FIG. 13 is an illustration showing a relation between horizontal scanning periods before and after frequency conversion.

With reference to FIG. 13, an outline of an operation of a liquid crystal display apparatus of the third embodiment is described. In FIG. 13, the input video signal is the same as that shown in FIG. 6, and 1.25 times frequency conversion is also performed, as is the case with the example shown in FIG. 6. FIG. 13 differs from FIG. 6 in the length of the horizontal scanning period in the vertical blanking period of the output video signal. Specifically, in the example of FIG. 13, in the vertical blanking period, the horizontal scanning periods corresponding to a timing at which the non-image signal is actually written into the pixels on the liquid crystal panel 107 have a length which is the same as the length (in this example, 320 μs) of the horizontal scanning period in the active video period. Considering that the length of the horizontal scanning periods corresponding to a timing at which the non-image signal is actually written into the pixels on the liquid crystal panel 107 are longer than the example shown in FIG. 6 (265.6 μs), other horizontal scanning periods become shorter (252.8 μs), compared to the example shown in FIG. 6. The horizontal scanning periods corresponding to a timing at which the non-image signal is actually written into the pixels on the liquid crystal panel 107 are three horizontal scanning periods among fifteen horizontal scanning periods included in the vertical blanking period, as shown in FIG. 7. During the first of the three horizontal scanning periods, the non-image signal is concurrently written into the pixels on the gate lines corresponding to the gate pulses P1 to P4, during the second of the three horizontal scanning periods, the non-image signal is concurrently written into the pixels on the gate lines corresponding to the gate pulses P5 to P8, and during the third of the three horizontal scanning periods, the non-image signal is concurrently written into the pixels on the gate lines corresponding to the gate pulses P9 to P12.

Figure 14:
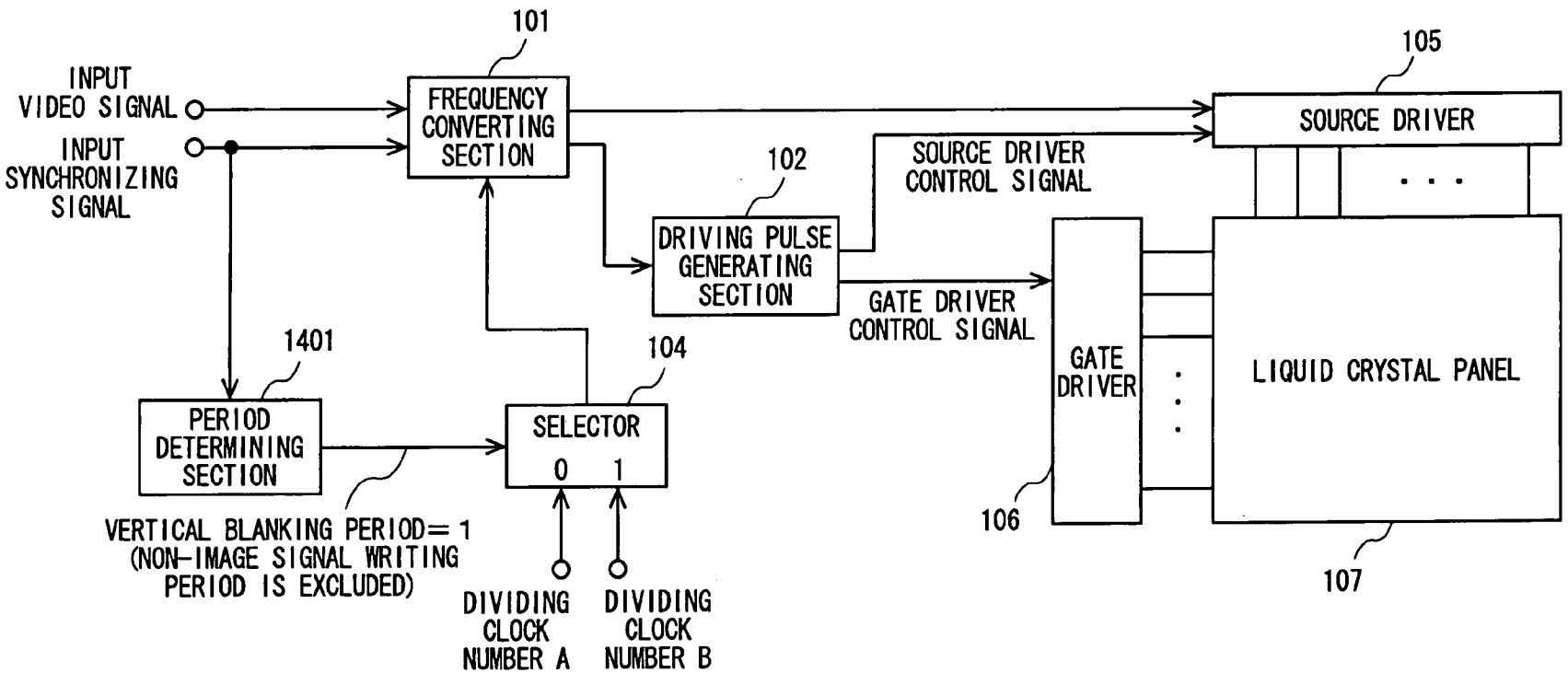
FIG. 14 is a block diagram showing the structure of a liquid crystal display apparatus according to a third embodiment of the present invention.

In order to realize the above-described operation, what is needed is to increase a dividing clock number of the horizontal scanning period corresponding to a timing at which the non-image signal is actually written into the pixels on the liquid crystal panel 107 during the vertical blanking period from 83 (a dividing clock number of the horizontal scanning period in the vertical blanking period in the output video signal shown in FIG. 6) to 100, and evenly reduce, in accordance with the above-described increase, the dividing clock number of the other horizontal scanning periods by (100−83)/4=4 (fractional portion is truncated) so as to become 83−4=79. In FIG. 14, a concrete example of the structure of the third embodiment is shown. In FIG. 14, in the vertical blanking period, a period determining section 1401 outputs "1" during the periods other than the horizontal scanning periods corresponding to a timing at which the non-image signal is actually written into the pixels on the liquid crystal panel 107, and outputs "0" during the other periods. In the above-described example, what is needed is to previously set 100 as the dividing clock number A and 79 as the dividing clock number B, which are to be supplied to the selector 104.

Figure 15:
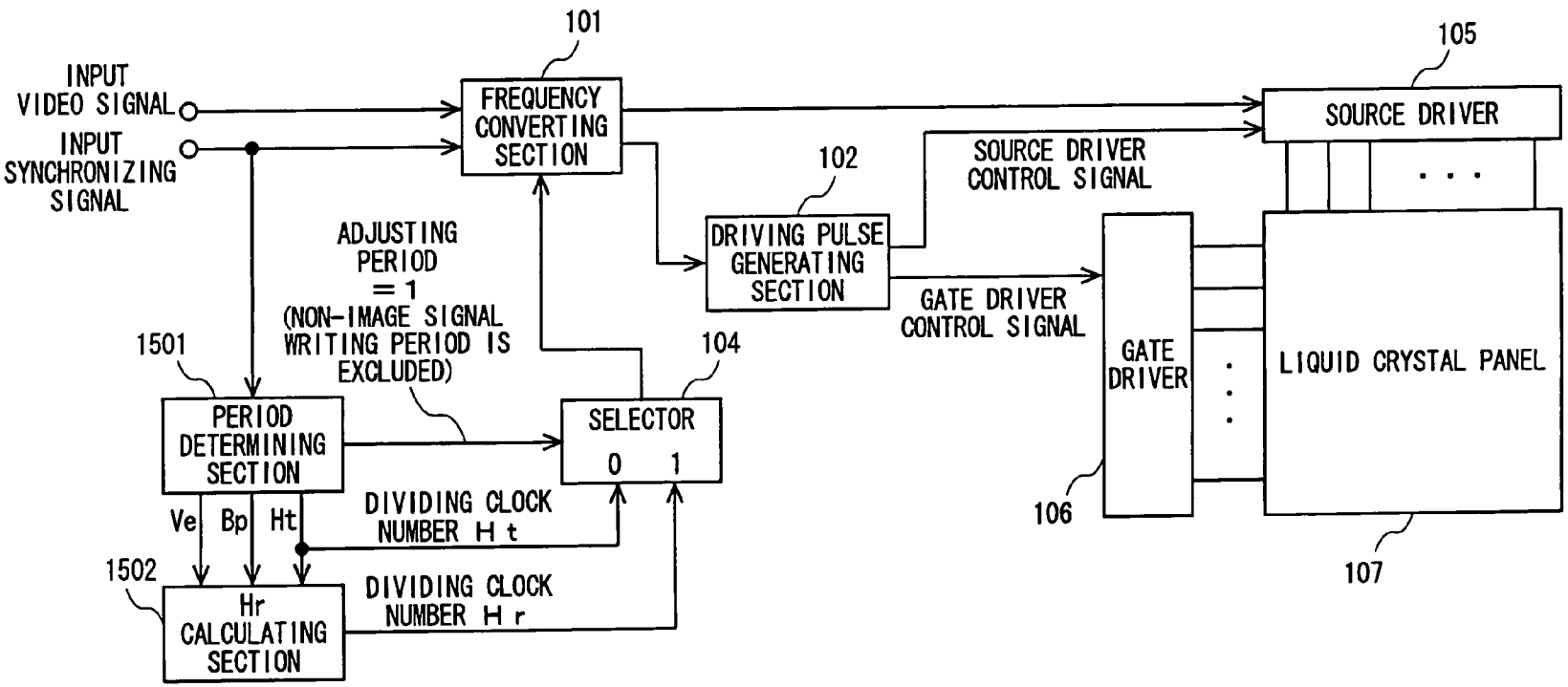
FIG. 15 is a block diagram showing the structure of a variant of the third embodiment.

Note that, in the above-described example, as is the case with the first embodiment, it is assumed that the number of horizontal scanning periods composing one frame period of the input video signal is unchanged, but it is possible to apply the third embodiment to a case where, as is the case with the second embodiment, the number of horizontal scanning periods composing one frame period of the input video signal dynamically fluctuates. The structure in that case is shown in FIG. 15. In FIG. 15, in the adjusting period, a period determining section 1501 outputs "1" during the periods other than the horizontal scanning periods corresponding to a timing at which the non-image signal is actually written into the pixels on the liquid crystal panel 107, and outputs "0" during the other periods. An Hr calculating section 1502 calculates Hr as follows. Note that the function F (x,n) is a function returning a value closest to x among values of odd multiple of n, and L is the number of gate lines into which a non-image signal is concurrently written.

$$Vr=F(Ve+Bp,L)$$

$$Hro=Bp/(Vr-Ve)\times Ht$$

$$Hr=Hro-(Ht-Hro)/L$$

In the above-described equations, Hro corresponds to Hr in the second embodiment. In a case where the input video signal is the same as that shown in FIG. 10, and 1.25 times frequency conversion is also performed (that is, in a case where L=4), Hr is 68 (fractional portion is truncated).

Figure 16:
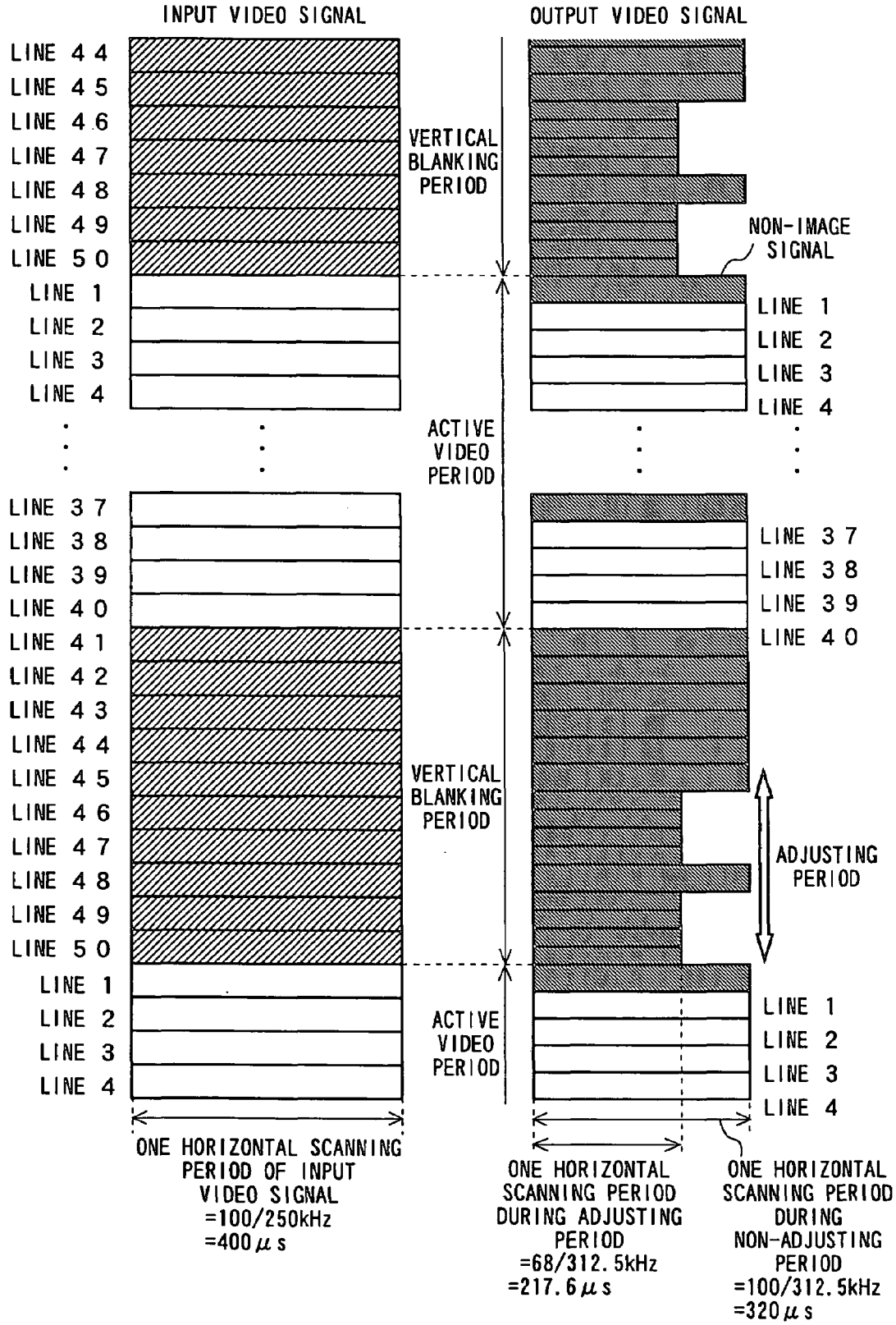
FIG. 16 is an illustration showing a relation between horizontal scanning periods before and after frequency conversion.

The selector 104 selects, based on the determination results of the period determining section 1501, either Ht or Hr, and outputs it to the frequency converting section 101, and the frequency converting section 101 outputs, based on the dividing clock number supplied from the selector 104, an output video signal as shown in FIG. 16.

Note that, in the above descriptions, it is assumed that a length of the horizontal scanning period corresponding to a timing at which the non-image signal is actually written into the pixels on the liquid crystal panel 107 during the vertical blanking period is unconditionally the same length of the horizontal scanning period in the active video period. However, if consideration is given only to prevention of inadequate writing of the non-image signal in this period, Ht may be used as the dividing clock number of this period only when Hro<Ht. For example, in a case as shown in FIG. 8 (Hro=110, Ht=100), there is enough writing time of the non-image signal in the vertical blanking period, whereby Hro (110) may be used as it is as the dividing clock number of the horizontal scanning period corresponding to a timing at which writing of the non-image signal is performed.

As such, according to the third embodiment, a length of the horizontal scanning period into which the non-image signal is written during the vertical blanking period is controlled so as to be the same length of the horizontal scanning period of the active video period, whereby it is possible to prevent fluctuations of the writing time of the non-image signal, and prevent irregularity of brightness.

(Fourth Embodiment)

Figure 17:
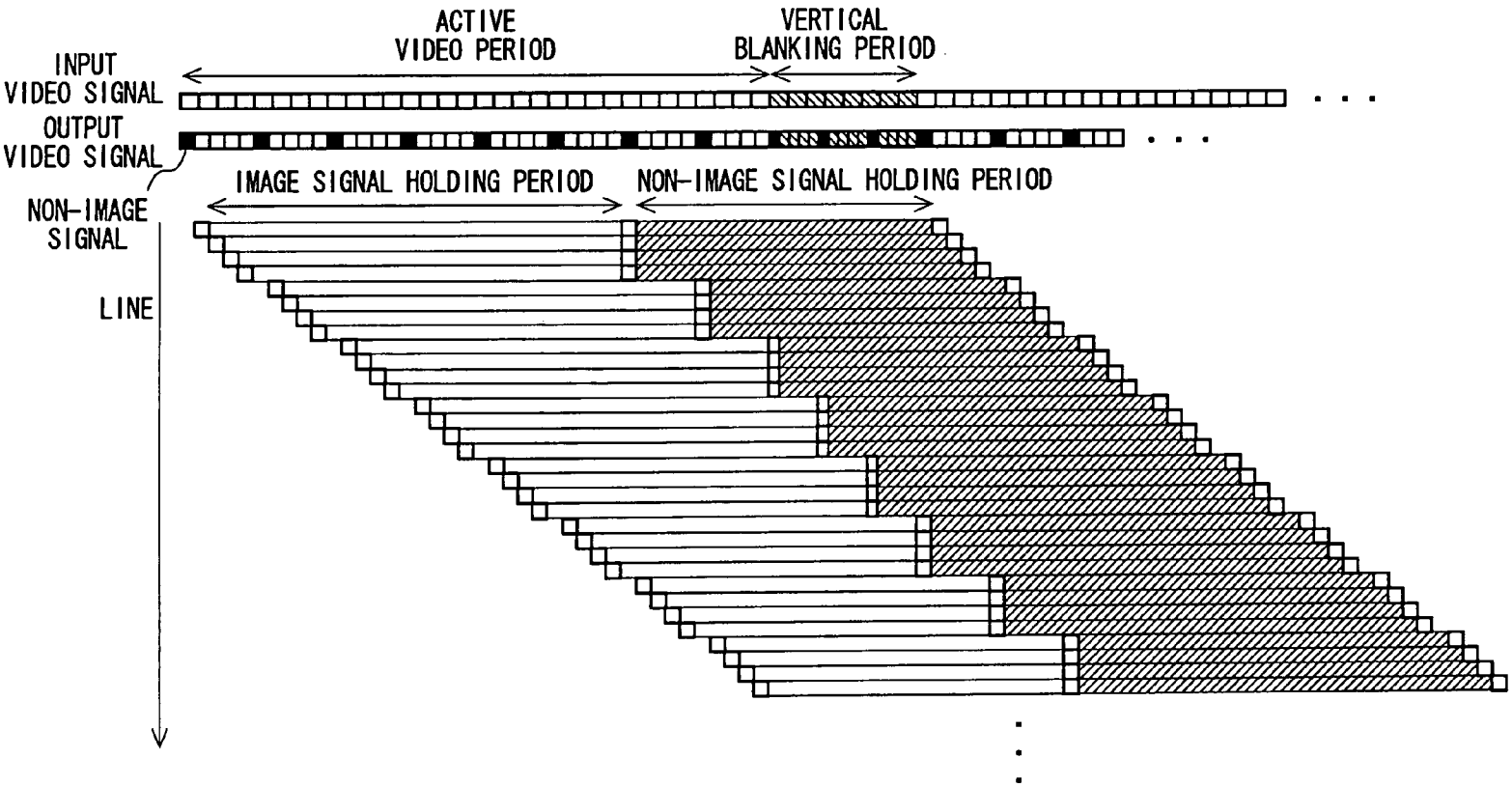
FIG. 17 is an illustration for describing a cause of irregularity of brightness.
Figure 18:
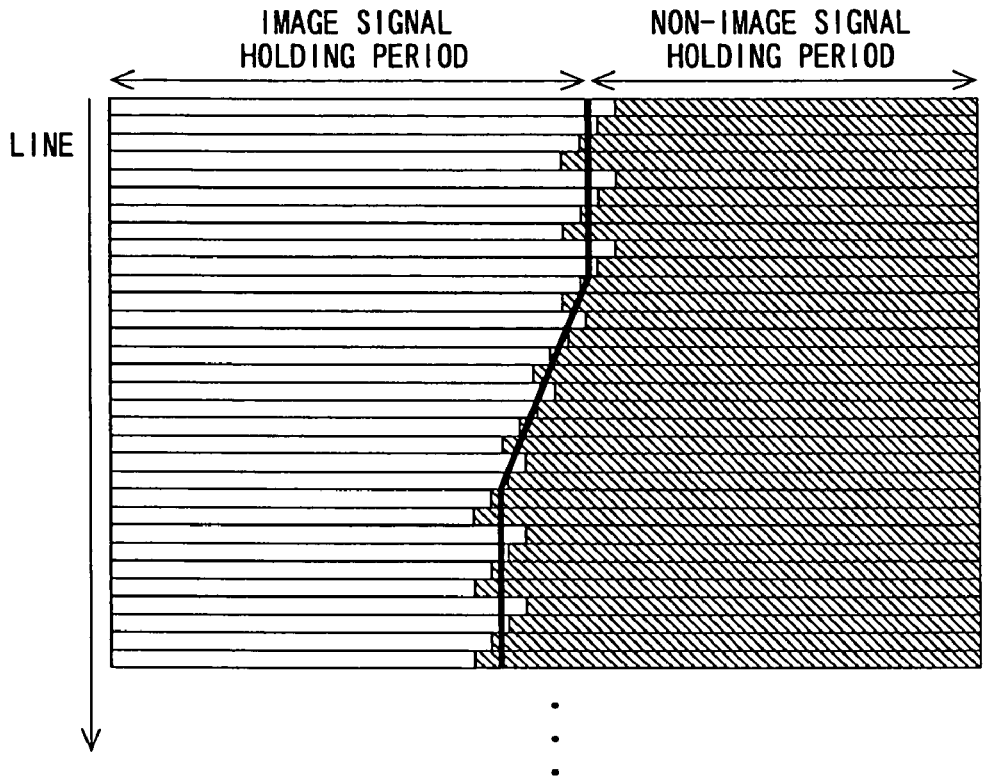
FIG. 18 is an illustration showing irregularity of brightness.

Now, in the aforementioned first embodiment, the respective horizontal scanning periods included in the vertical blanking period of the output video signal have uniform lengths, but the number of horizontal scanning periods in the vertical blanking period is increased/decreased, whereby there is a possibility that a length of the horizontal scanning period in the active video period differs significantly from a length of the horizontal scanning period in the vertical blanking period. The greater the difference becomes, the higher the possibility of occurrence of irregularity of brightness becomes. With reference to FIGS. 17 and 18, the principle thereof will be described.

In the anti-back-transition driving, writing of one image signal and one non-image signal is alternately performed during one frame period. In FIG. 17, in each line, an image signal holding period (a period from writing of the image signal to subsequent writing of the non-image signal) and a non-image signal holding period (a period from writing of the non-image signal to subsequent writing of the image signal) are shown. FIG. 18 shows a ratio between the image signal holding period and the non-image signal holding period in one frame period on a line basis. As shown in FIG. 18, the ratio varies by line. This is because a length of the horizontal scanning period of the vertical blanking period is different from that of the active video period. A fourth embodiment is characterized in that the above-described irregularity in brightness is less noticeable.

Figure 19:
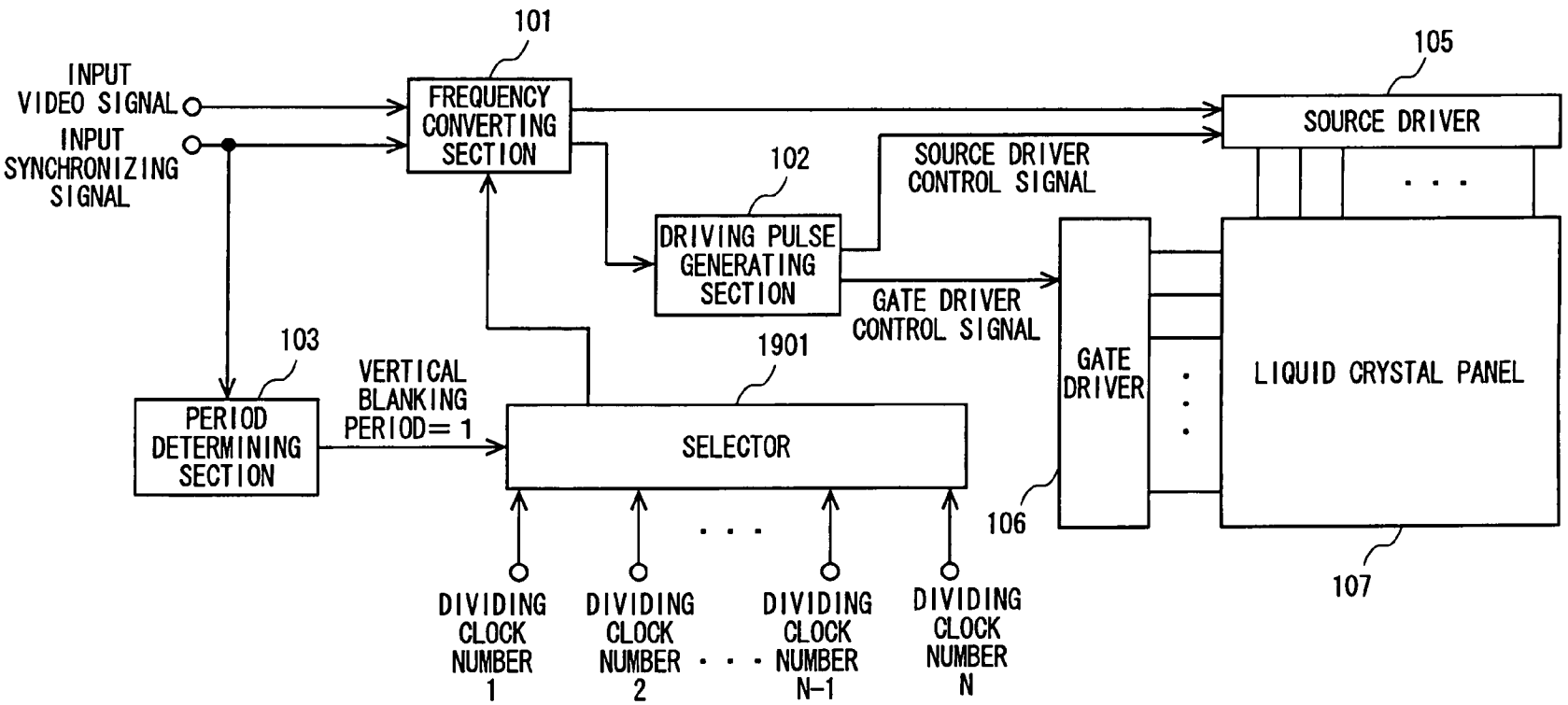
FIG. 19 is a block diagram showing the structure of a liquid crystal display apparatus according to a fourth embodiment of the present invention.

In FIG. 19, the structure of a liquid crystal display apparatus according to the fourth embodiment of the present invention is shown. In FIG. 19, the liquid crystal display apparatus includes the frequency converting section 101, the driving pulse generating section 102, the period determining section 103, the source driver 105, the gate driver 106, the liquid crystal panel 107, and a selector 1901. Note that any component elements in FIG. 19 similar to those in FIG. 1 are denoted by like numerals, with the descriptions thereof omitted.

The third embodiment is characterized in that the dividing clock number is gradually changed, instead of being changed in a binary manner, as described in the first embodiment, between the active video period and the vertical blanking period. Hereinafter, by taking a case as an example, in which the input video signal is a signal shown in FIG. 6, an operation of the third embodiment will be described.

Figure 20:
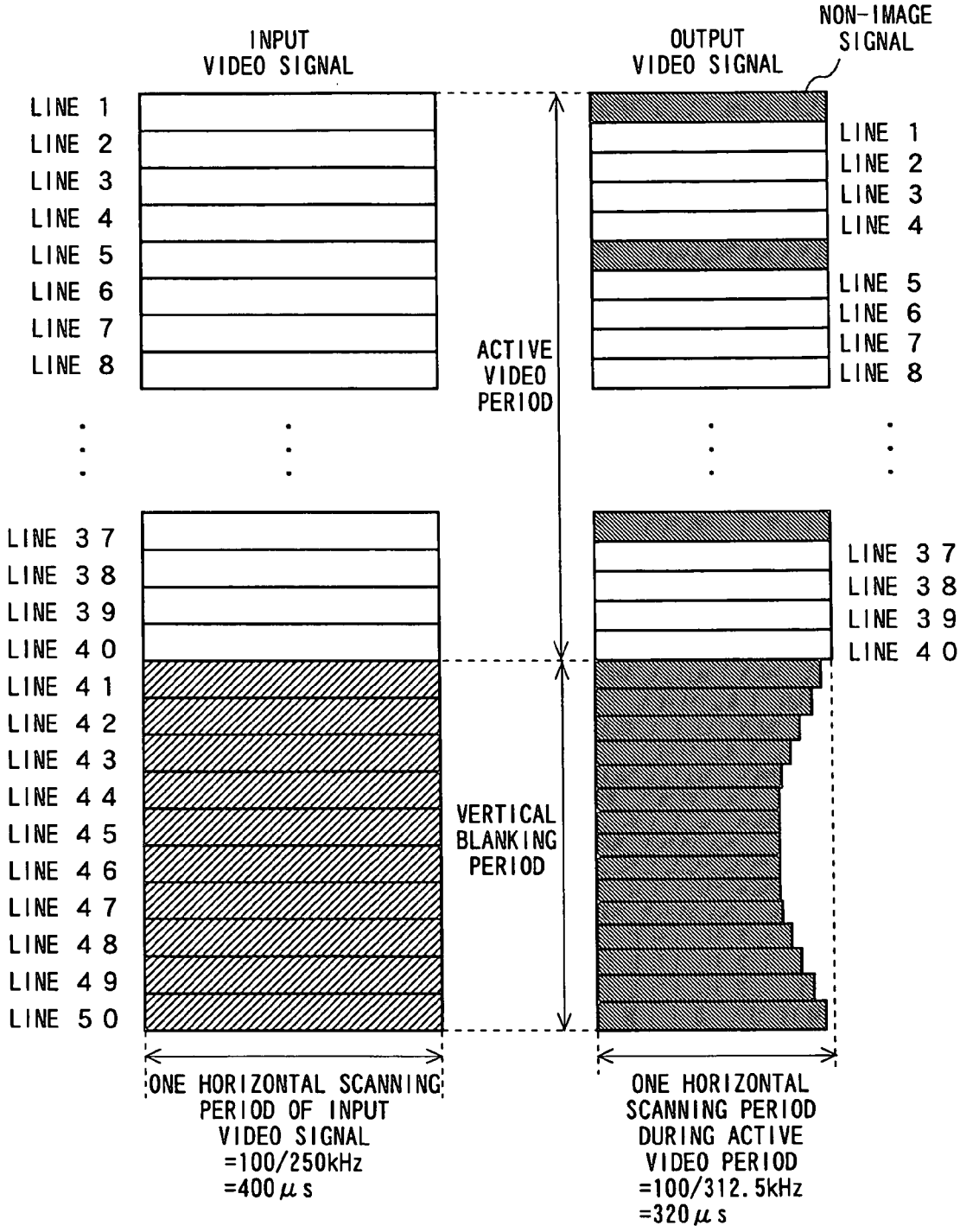
FIG. 20 is an illustration showing a relation between horizontal scanning periods before and after frequency conversion.
Figure 21:
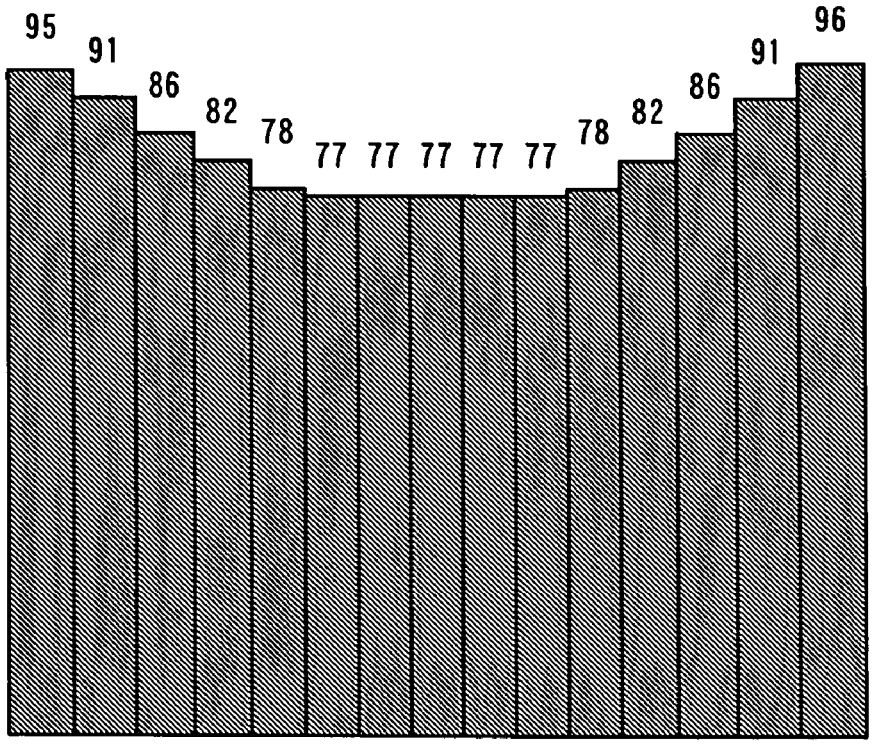
FIG. 21 is an illustration showing respective horizontal scanning periods during a vertical blanking period.

To the selector 1901, fifteen dividing clock numbers are supplied. These dividing clock numbers are sequentially set, for example, 95, 91, 86, 82, 78, 77, 77, 77, 77, 77, 78, 82, 86, 91, 96, and the selector 1901 switches these dividing clock numbers in a sequential order, and supplies them to the frequency converting section 101 during the vertical blanking period. The total sum of the dividing clock numbers is determined in accordance with the length of the vertical blanking period. For example, in the above-described example, the vertical blanking period is 20×10/50=4 ms, whereby each dividing clock number is set so that the total sum of the dividing clock numbers becomes 312.5 kHz×4 ms=1250. In FIG. 20, a relation between horizontal scanning periods before and after frequency conversion is shown. Also, in FIG. 21, a relation of lengths of the respective horizontal scanning periods during the vertical blanking period is shown.

Figure 22:
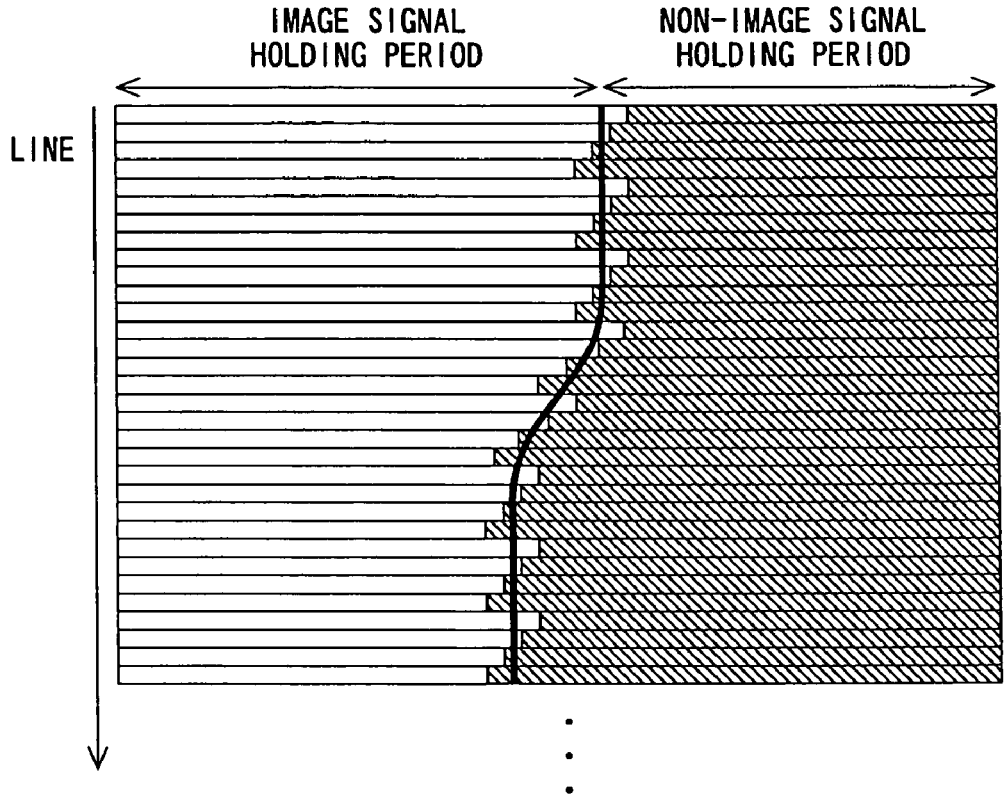
FIG. 22 is an illustration showing irregularity of brightness.

As a result of the above-described control, a ratio between the image signal holding period and the non-image signal holding period in one frame period on a line basis is changed into one shown in FIG. 22, whereby irregularity of brightness is further improved compared to the example shown in FIG. 18.

(Fifth Embodiment)

In the above-described first to fourth embodiments, it is assumed that the number of horizontal scanning periods is adjusted by controlling the dividing clock number supplied to the frequency converting section 101, but the present invention, which is not limited thereto, can achieve the same effects by switching a clock while fixing the dividing clock number. Hereinafter, as a fifth embodiment, a structure in which the clock to be supplied to the frequency converting section is switched between the active video period and the vertical blanking period will be described.

Figure 23:
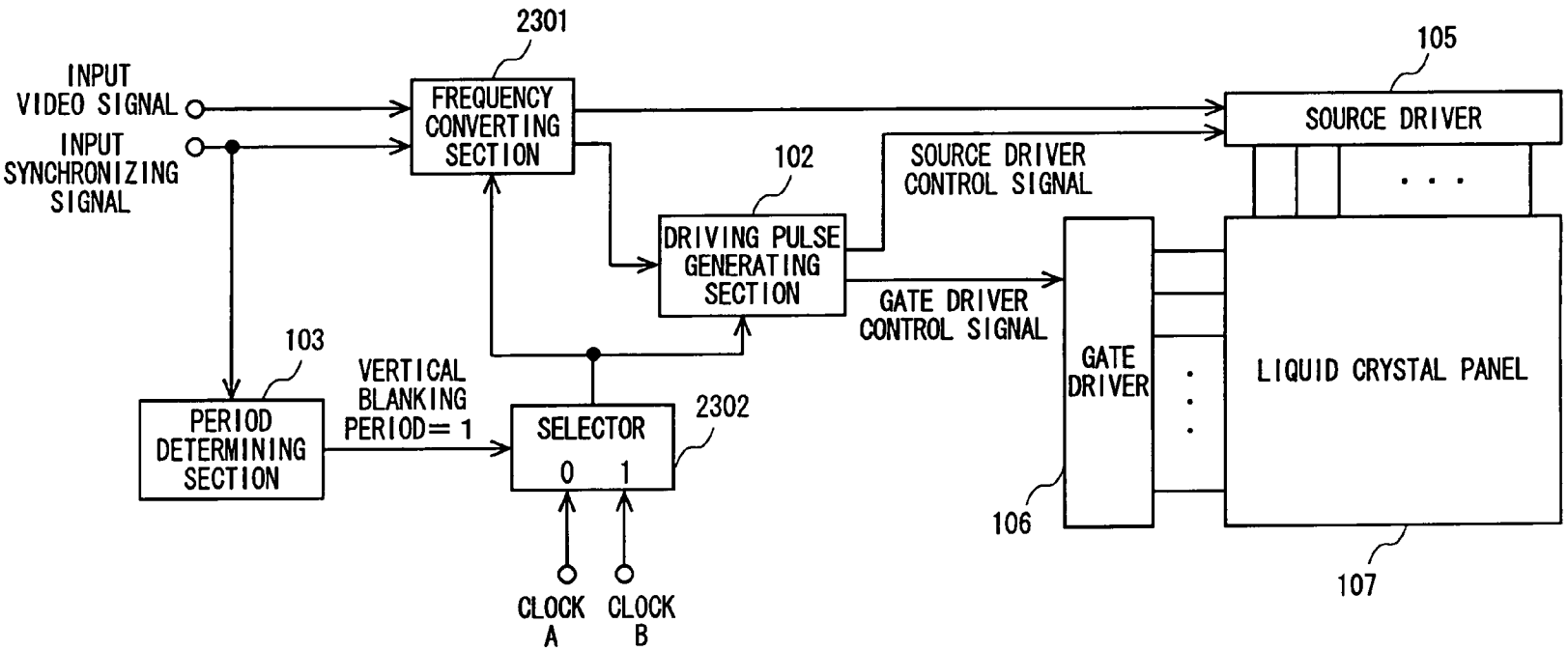
FIG. 23 is a block diagram showing the structure of a liquid crystal display apparatus according to a fifth embodiment of the present invention.

In FIG. 23, the structure of a liquid crystal display apparatus according to the fifth embodiment of the present invention is shown. In FIG. 23, the liquid crystal display apparatus includes the driving pulse generating section 102, the period determining section 103, the source driver 105, the gate driver 106, the liquid crystal panel 107, a frequency converting section 2301, and a selector 2302. Note that any component elements in FIG. 23 similar to those in FIG. 1 are denoted by like numerals, with the descriptions thereof omitted.

To the selector 2302, a clock A (312.5 kHz) and a clock B (375 kHz), which have different frequencies, are supplied, and the selector 2302 selects either of the clocks in accordance with the determination results of the period determining section 103, and supplies it to the frequency converting section 2301. Specifically, during the active video period, the clock A is output, and the clock B is output during the vertical blanking period.

Figure 24:
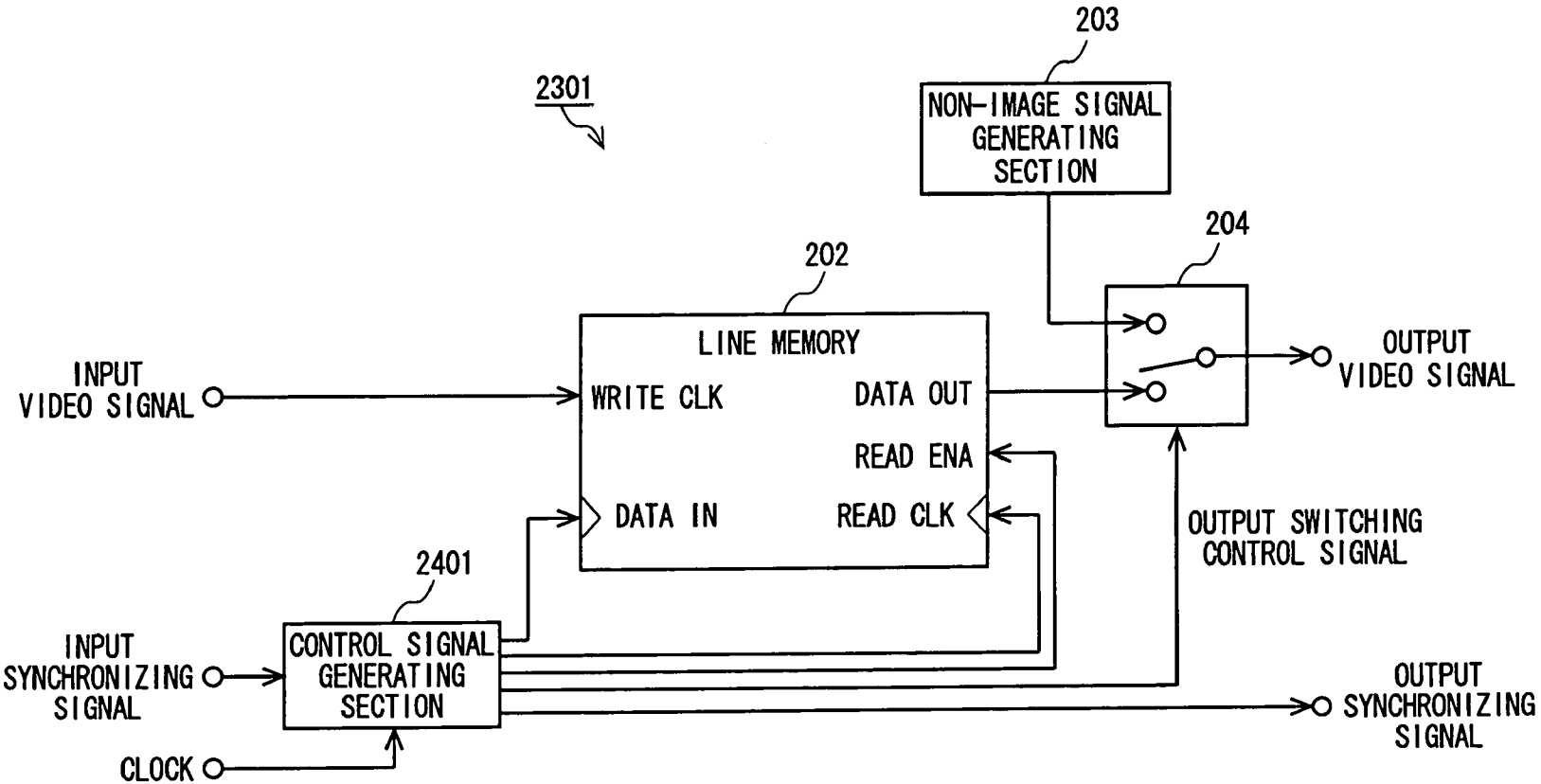
FIG. 24 is a block diagram showing the structure of a frequency converting section.
Figure 25:
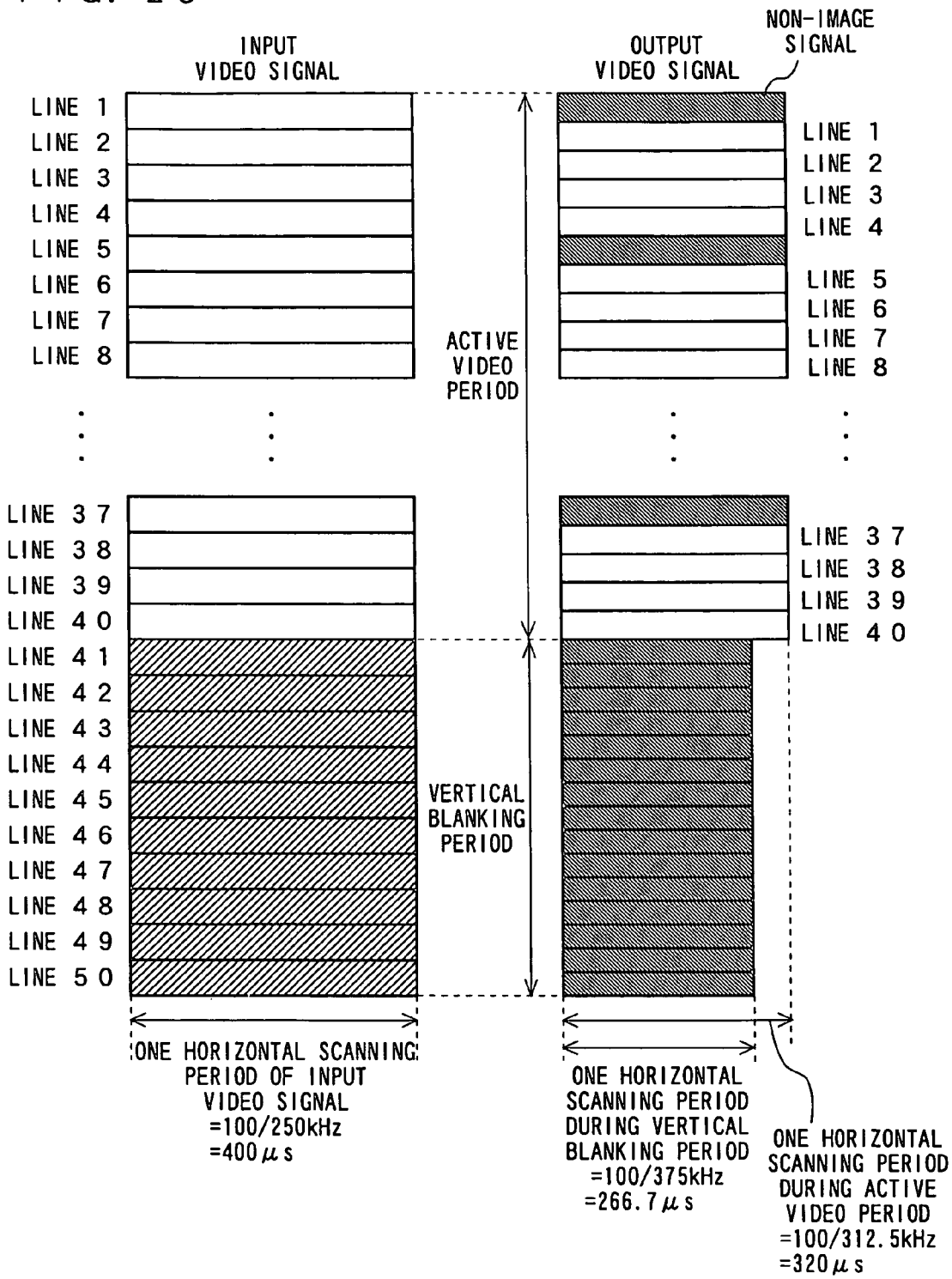
FIG. 25 is an illustration showing a relation between horizontal scanning periods before and after frequency conversion.
Figure 26:
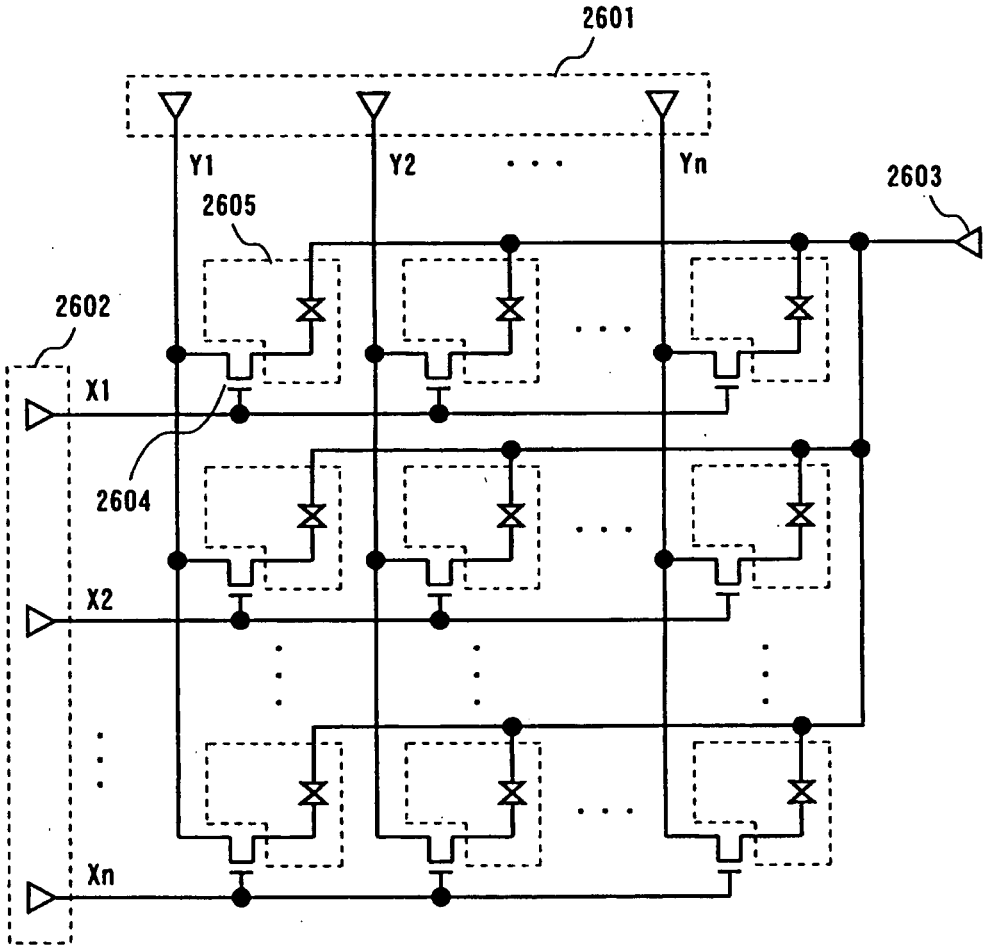
FIG. 26 PRIOR ART
FIG. 26 is an illustration showing the structure of a commonly-used liquid crystal panel.
Figure 27:
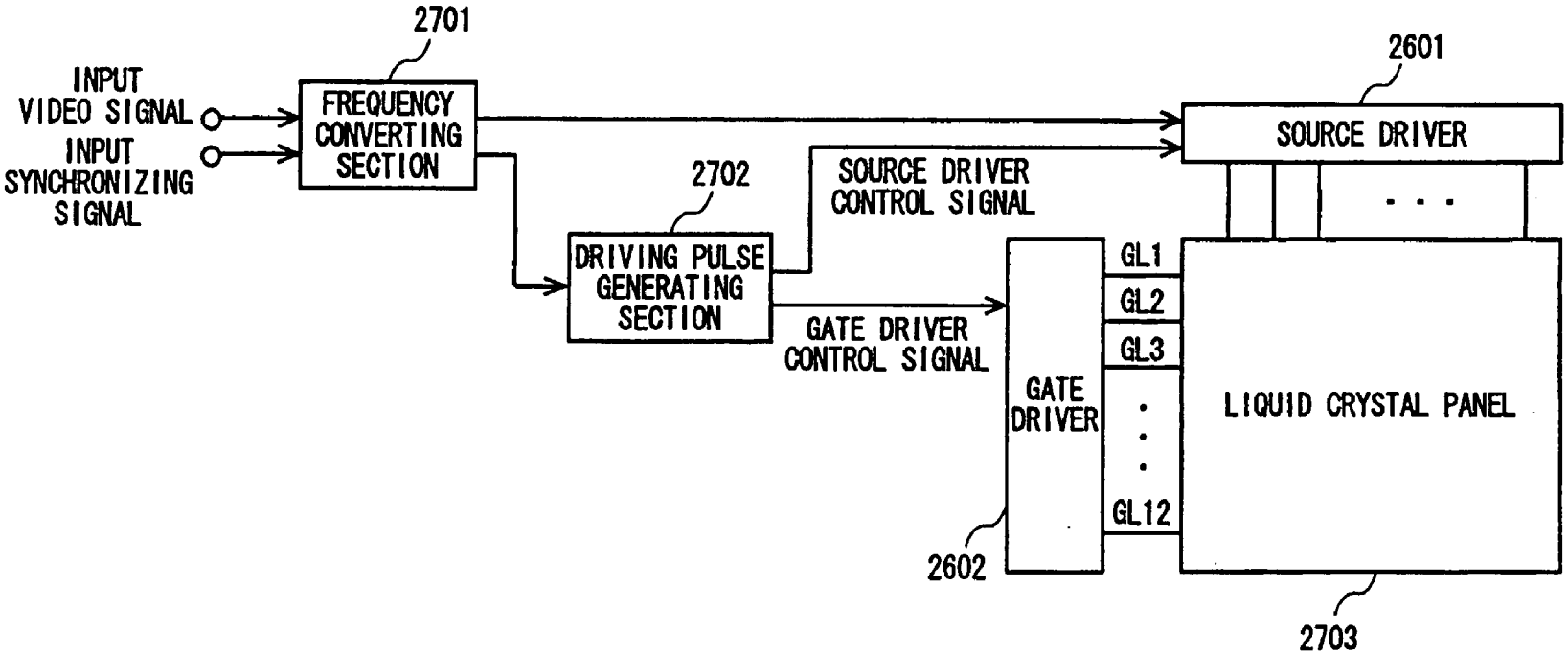
FIG. 27 PRIOR ART
FIG. 27 is a block diagram showing the structure of a liquid crystal display apparatus according to the related art.
Figure 28:
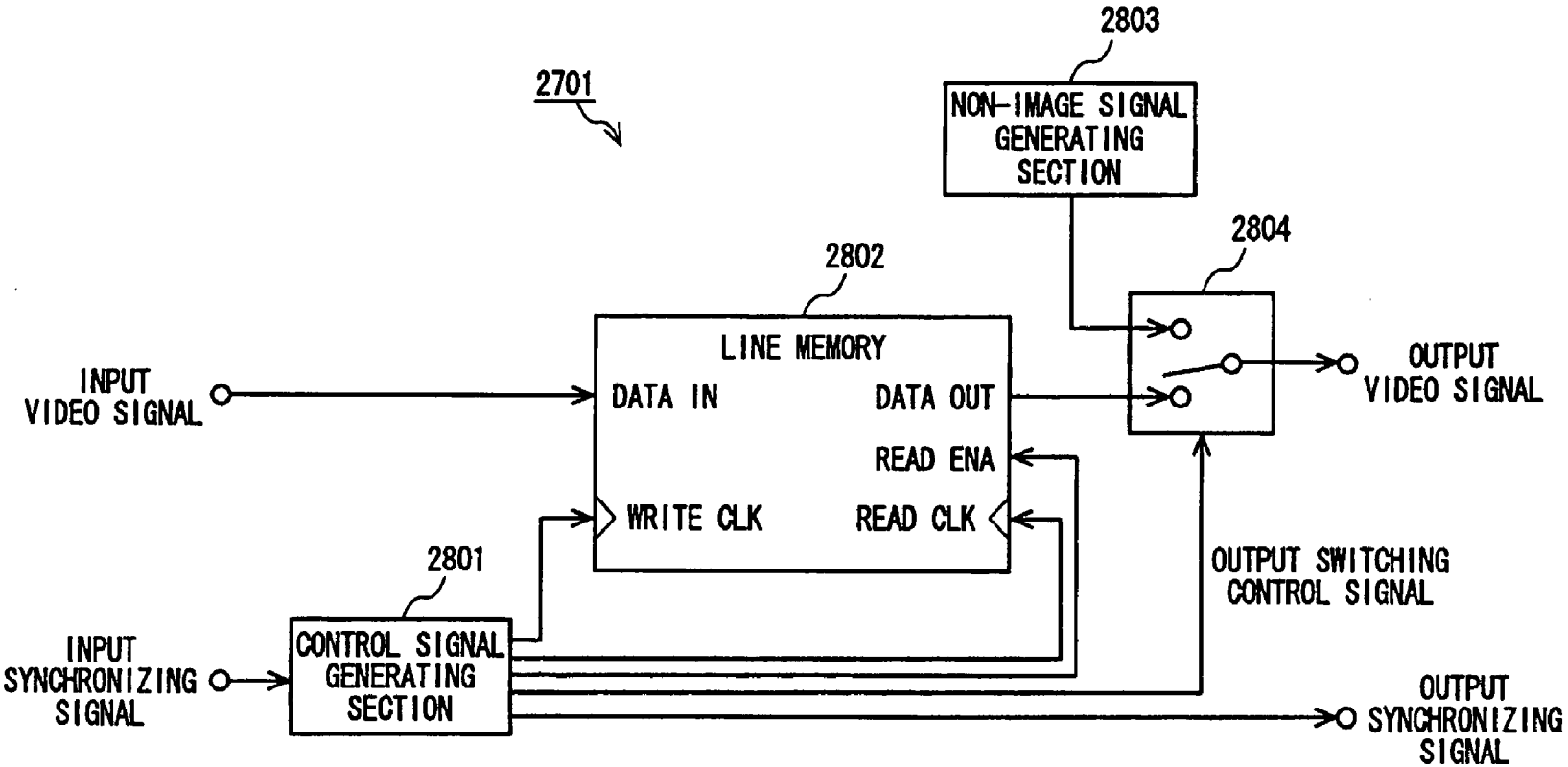
FIG. 28 PRIOR ART
FIG. 28 is a block diagram showing the structure of a frequency converting section.

In FIG. 24, the structure of the frequency converting section 2301 is shown. Note that any component elements in FIG. 24 similar to those in FIG. 2 are denoted by like numerals, with the descriptions thereof omitted. A control signal generating section 2401 uses the clock supplied from the selector 2302 as a reading clock of the line memory 202. That is, during the active video period, data is read from the line memory 202 based on the clock of 312.5 kHz, and data is read from the line memory 202 based on the clock of 375 kHz during the vertical blanking period. As a result, a relation between horizontal scanning periods before and after frequency conversion is shown in FIG. 25. Thus, the number of horizontal scanning periods composing one frame period of the output video signal becomes an odd multiple of (L+1), whereby it is possible to achieve the same effect as that of the first embodiment.

Note that it is assumed that the fifth embodiment has the structure in which the clock is switched by the selector 2302, but the present invention, which is not limited thereto, may have the structure in which a frequency of a single clock is changed, as appropriate, using a PLL, for example.

Now, it is known that applying of a black-level non-image signal to the liquid crystal cells for only a time period predetermined for each frame prevents blurring of moving images, which is typical of a hold-type display element, and enhances a moving image display capability of the liquid crystal panel. The difference between the above-described driving in which the black-level non-image signal is applied to the liquid crystal cells for only a time period predetermined for each frame and the anti-back-transition driving is whether the non-image signal is a black-level signal or a high-voltage signal. Thus, even in a case where the black-level non-image signal is applied to the liquid crystal cells for a time period predetermined for each frame, irregularity of brightness occurs on the same principle as that of the anti-back-transition driving, but it is possible to prevent the irregularity of brightness using the same methods described in the above-described embodiments. Thus, the present invention can be applied not only to driving of the liquid crystal panel in OCB mode, but also to driving of a liquid crystal panel in other modes (for example, TN mode).

INDUSTRIAL APPLICABILITY

As described above, according to the present invention, in a case, for example, where anti-back-transition driving is performed using a liquid crystal panel in OCB mode, it is possible to minimize increase of a driving frequency, prevent irregularity of brightness caused by AC driving of the liquid crystal panel, and reduce cost.

The invention claimed is:

1. A liquid crystal display apparatus for displaying video by driving a liquid crystal panel based on an input video signal, the liquid crystal display apparatus comprising:

a liquid crystal panel having a plurality of source lines and a plurality of gate lines;

a frequency converting section for generating an output video signal by inserting one non-image signal, which is to be concurrently written into pixels on L (L is an integer equal to or greater than two) gate lines of the liquid crystal panel, for one line, between image signals composing the input video signal, for corresponding L lines, and adjusting a number of horizontal scanning periods of the output video signal so that a number of horizontal scanning periods composing one frame period is $(L+1)\times(2N+1)$ (N is an integer); and a driver for driving the liquid crystal panel based on the output video signal generated by the frequency converting section, wherein the frequency converting section increases/decreases a number of horizontal scanning periods included in a vertical blanking period, thereby adjusting the number of horizontal scanning periods composing one frame period.

2. The liquid crystal display apparatus according to claim 1, wherein the liquid crystal panel is a liquid crystal panel in OCB mode, and the non-image signal is a signal for applying a predetermined high voltage to a liquid crystal of the liquid crystal panel so as to prevent a back-transition.

3. The liquid crystal display apparatus according to claim 1, wherein the non-image signal is a black-level signal.

4. The liquid crystal display apparatus according to claim 1, wherein the frequency converting section generates the output video signal based on either a dividing clock number for an adjusting period in a vertical blanking period or a different dividing clock number for periods other than the adjusting period in one frame period.

5. The liquid crystal display apparatus according to claim 4, further comprising:

a period determining section for determining whether or not an image signal supplied to the frequency converting section corresponds to the adjusting period, based on a synchronizing signal synchronized with the input video signal; and a selector for supplying, to the frequency converting section, either a dividing clock number for an adjusting period in a vertical blanking period or a different dividing clock number for periods other than the adjusting period in one frame period, based on results determined by the period determining section.

6. The liquid crystal display apparatus according to claim 4, wherein the adjusting period is a period from an input of a vertical synchronizing pulse to an end of a vertical blanking period, and the liquid crystal display apparatus further characterized by comprising a dividing clock number calculating section for calculating, based on a number of horizontal scanning periods included in a period from a start of an active video period to an input of a vertical synchronizing pulse, a dividing clock number corresponding to a following adjusting period.

7. The liquid crystal display apparatus according to claim 1, wherein the frequency converting section increases/decreases a number of horizontal scanning periods included in a period from an input of a vertical synchronizing pulse to an end of a vertical blanking period, based on a number of horizontal scanning periods included in a period from a start of an active video period to an input of the vertical synchronizing pulse.

8. The liquid crystal display apparatus according to claim 1, wherein the frequency converting section generates an output video signal whose length of horizontal scanning period, which corresponds to a timing at which the non-image signal is written into pixels of the liquid crystal panel in an adjusting period included in the vertical blanking period, is equal to or greater than a length of a horizontal scanning period included in periods other than the adjusting period of one frame period.

9. The liquid crystal display apparatus according to claim 1, wherein the frequency converting section generates an output video signal whose lengths of respective horizontal scanning periods are substantially uniform in an adjusting period included in the vertical blanking period.

10. The liquid crystal display apparatus according to claim 1, wherein the frequency converting section generates an output video signal whose lengths of respective horizontal scanning periods are gradually changed in an adjusting period included in the vertical blanking period.

11. A liquid crystal display apparatus driving method for displaying video by driving a liquid crystal panel having a plurality of source lines and a plurality of gate lines, based on an input video signal, the method characterized by:

generating an output video signal by inserting one non-image signal, which is to be concurrently written into pixels on L (L is an integer equal to or greater than two) gate lines of the liquid crystal panel, for one line, between image signals composing the input video signal, for corresponding L lines, and adjusting a number of horizontal scanning periods of the output video signal so that a number of horizontal scanning periods composing one frame period is $(L+1)\times(2N+1)$ (N is an integer);

driving the liquid crystal panel based on the output video signal; and increasing/decreasing a number of horizontal scanning periods included in a vertical blanking period, thereby adjusting a number of horizontal scanning periods composing one frame period.

12. The liquid crystal display apparatus driving method according to claim 11, further characterized by generating the output video signal based on either a dividing clock number for an adjusting period in a vertical blanking period or a different dividing clock number for periods other than the adjusting period in one frame period.

13. The liquid crystal display apparatus driving method according to claim 12, further characterized by:

making determination, based on a synchronizing signal synchronized with an input video signal, whether or not each image signal included in the input video signal corresponds to the adjusting period;

selecting either a dividing clock number for an adjusting period or a different dividing clock number for periods other than the adjusting period in one frame period, based on the determination results; and generating the output video signal based on the selected dividing clock number.

14. The liquid crystal display apparatus driving method according to claim 12, wherein the adjusting period is a period from an input of a vertical synchronizing pulse to an end of a vertical blanking period, and the method further characterized by:

calculating a dividing clock number, based on a number of horizontal scanning periods included in a period from a start of an active video period to an input of a vertical synchronizing pulse, the dividing clock number corresponding to a following adjusting period.

15. The liquid crystal display apparatus driving method according to claim 11, further characterized by increasing/decreasing a number of horizontal scanning periods included in a period from an input of a vertical synchronizing pulse to an end of a vertical blanking period, based on a number of horizontal scanning periods included in a period from a start of an active video period to an input of a vertical synchronizing pulse.

16. The liquid crystal display apparatus driving method according to claim 11, further characterized by generating an output video signal whose length of a horizontal scanning period corresponding to a timing at which the non-image signal is written into pixels of the liquid crystal panel in an adjusting period included in the vertical blanking period is equal to or greater than a length of a horizontal scanning period in periods other than the adjusting period in one frame period.

17. The liquid crystal display apparatus driving method according to claim 11, further characterized by generating an output video signal whose lengths of respective horizontal scanning period are substantially uniform in an adjusting period included in the vertical blanking period.

18. The liquid crystal display apparatus driving method according to claim 11, further characterized by generating an output video signal whose lengths of respective horizontal scanning period are gradually changed in an adjusting period included in the vertical blanking period.

* * * * *